US010016804B2

(12) United States Patent
Tanaka et al.

(10) Patent No.: US 10,016,804 B2
(45) Date of Patent: Jul. 10, 2018

(54) HAT-SHAPED CROSS-SECTION COMPONENT MANUFACTURING APPARATUS AND MANUFACTURING METHOD

(71) Applicant: NIPPON STEEL & SUMITOMO METAL CORPORATION, Tokyo (JP)

(72) Inventors: Yasuharu Tanaka, Tokyo (JP); Toshimitsu Aso, Tokyo (JP); Takashi Miyagi, Tokyo (JP); Misao Ogawa, Tokyo (JP); Shinobu Yamamoto, Tokyo (JP); Eizo Hayashida, Gotsu (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 15/029,574

(22) PCT Filed: Oct. 16, 2014

(86) PCT No.: PCT/JP2014/077612
§ 371 (c)(1),
(2) Date: Apr. 14, 2016

(87) PCT Pub. No.: WO2015/060202
PCT Pub. Date: Apr. 30, 2015

(65) Prior Publication Data

US 2016/0271682 A1 Sep. 22, 2016

(30) Foreign Application Priority Data

Oct. 24, 2013 (JP) ..... 2013-221522

(51) Int. Cl.
*B21J 5/02* (2006.01)
*B21D 22/26* (2006.01)
(Continued)

(52) U.S. Cl.
CPC ..... *B21J 5/02* (2013.01); *B21D 22/26* (2013.01); *B21D 24/04* (2013.01); *B21D 45/02* (2013.01)

(58) Field of Classification Search
CPC ..... B21J 5/02; B21J 5/025; B21J 13/02; B21J 13/025; B21J 13/04; B21J 13/08;
(Continued)

(56) References Cited

U.S. PATENT DOCUMENTS 4,125,009 A 11/1978 Byrd et al.
5,211,047 A * 5/1993 Kaneyuki ..... B21D 11/10 72/313
(Continued)

FOREIGN PATENT DOCUMENTS

JP 44-2698 Y1 1/1969
JP 53-135875 A 11/1978
(Continued)

OTHER PUBLICATIONS

Merriam Webster definition of Interpose.*
(Continued)

*Primary Examiner* — R. K. Arundale
*Assistant Examiner* — Pradeep C Battula
(74) *Attorney, Agent, or Firm* — Birch, Stewart, Kolasch & Birch, LLP

(57) ABSTRACT

A hat-shaped cross-section component manufacturing apparatus includes: a die that includes a forming face that presses both side portions of a metal stock sheet; a punch that includes a forming face that presses a central portion of the metal stock sheet; a pad that includes a forming face that presses and grips the central portion of the metal stock sheet against the punch; and a blank holder that includes a forming face that presses and grips the both side portions of the metal stock sheet against the die. The hat-shaped cross-section
(Continued)

component manufacturing apparatus further includes a pressure limiting device configured including a floating block that moves together with the blank holder when forming of a curving component has been completed, that is interposed between the pad and the blank holder, and that limits pressing of the formed curving component between the pad and the blank holder during demolding.

7 Claims, 44 Drawing Sheets

(51) Int. Cl.
*B21D 24/04* (2006.01)
*B21D 45/02* (2006.01)

(58) Field of Classification Search
CPC ..... B21D 22/02; B21D 22/10; B21D 22/22; B21D 22/26; B21D 24/02; B21D 24/10; B21D 24/12; B21D 24/14; B21D 45/02
See application file for complete search history.

(56) References Cited

U.S. PATENT DOCUMENTS

| | | | | |
|---|---|---|---|---|
| 5,499,525 | A * | 3/1996 | Kordak | B21D 24/14 100/259 |
| 5,692,405 | A * | 12/1997 | Kirii | G05B 19/4163 72/16.1 |
| 7,971,466 | B2 * | 7/2011 | Yoshitome | B21D 22/02 72/355.2 |
| 8,250,896 | B2 * | 8/2012 | Hirotani | B21D 22/22 72/313 |
| 2005/0262917 | A1 | 12/2005 | Osumi et al. | |
| 2012/0324974 | A1 | 12/2012 | Nakamura et al. | |
| 2014/0356643 | A1 * | 12/2014 | Nakata | B21D 22/26 428/603 |
| 2015/0224563 | A1 | 8/2015 | Aso et al. | |

FOREIGN PATENT DOCUMENTS

| | | | |
|---|---|---|---|
| JP | 54-121954 | | 8/1979 |
| JP | 59-175427 | U | 11/1984 |
| JP | 63-242423 | A | 10/1988 |
| JP | 4-422 | U | 1/1992 |
| JP | 4-178225 | A | 6/1992 |
| JP | 7-185684 | A | 7/1995 |
| JP | 10-244324 | A | 9/1998 |
| JP | 2003-103306 | A | 4/2003 |
| JP | 2004-154859 | A | 6/2004 |
| JP | 2006-15404 | A | 1/2006 |
| JP | 2008-307557 | A | 12/2008 |
| JP | 2009-241109 | A | 10/2009 |
| JP | 2013-6208 | A | 1/2013 |
| WO | WO 2014/042067 | A1 | 3/2014 |

OTHER PUBLICATIONS

International Search Report for PCT/JP2014/077612 dated Nov. 18, 2014.
Written Opinion of the International Searching Authority for PCT/JP2014/077612 (PCT/ISA/237) dated Nov. 18, 2014.
Korean Office Action dated May 22, 2017, for corresponding Korean Application No. 10-2016-7008803, with English translation.

* cited by examiner

CROSS-SECTION AA

HAT-SHAPED CROSS-SECTION COMPONENT MANUFACTURING APPARATUS AND MANUFACTURING METHOD

TECHNICAL FIELD

The present invention relates to a hat-shaped cross-section component manufacturing apparatus for and a manufacturing method for manufacturing a component with a hat-shaped cross-section.

BACKGROUND ART

Pressed components with a hat-shaped cross-section profile (also referred to as "hat-shaped cross-section components" in the present specification), such as front side members, are known structural members configuring automotive vehicle body framework. Such hat-shaped cross-section components are formed by performing press working (drawing) or the like on metal sheet materials (for example, steel sheets) (see, for example, Japanese Patent Application Laid-Open (JP-A) Nos. 2003-103306, 2004-154859, 2006-015404, and 2008-307557).

SUMMARY OF INVENTION

Technical Problem

When a hat-shaped cross-section component is formed by drawing a metal sheet, it is important to remove the hat-shaped cross-section component during demolding while avoiding deformation as much as possible.

In consideration of the above circumstances, an object of the present invention is to obtain a hat-shaped cross-section component manufacturing apparatus capable of suppressing deformation of a hat-shaped cross-section component during demolding.

Solution to Problem

A hat-shaped cross-section component manufacturing apparatus that addresses the above issue includes: a die that includes a forming face that presses both side portions of a metal sheet, and that includes an opening; a punch that is disposed facing the opening of the die, wherein the punch is disposed inside the opening when a mold is closed, and wherein the punch includes a forming face that presses a central portion of the metal sheet; a pad that is disposed inside the opening formed in the die, wherein the pad includes a forming face that presses and grips the central portion of the metal sheet against the punch when the mold is closed so as to configure a forming face corresponding to the forming face of the punch; a holder that is disposed facing the die, wherein the holder includes a forming face that presses and grips both side portions of the metal sheet against the die when the mold is closed so as to configure a forming face corresponding to the forming face of the die; and a pressure limiting device that includes a pressure limiting section that moves together with the holder during demolding after forming a hat-shaped cross-section component with a hat shaped cross-section, wherein the pressure limiting device is interposed between the pad and the holder, and wherein the pressure limits pressing on the hat-shaped cross-section component by the pad and the holder.

A hat-shaped cross-section component manufacturing method that addresses the above issue employs the hat-shaped cross-section component manufacturing apparatus above, and includes: a forming process of forming the hat-shaped cross-section component by configuring a metal sheet that is curved up-down by gripping the central portion of the metal sheet between the punch and the pad, and gripping the both side portions of the metal sheet between the die and the holder, and moving the holder and die, and the punch and pad, up-down relative to each other; and a demolding process of demolding the hat-shaped cross-section component by moving one or both out of the die or the blank holder in a demolding direction in a state in which the pad and the pressure limiting section are in contact with each other.

In the hat-shaped cross-section component manufacturing apparatus and the hat-shaped cross-section component manufacturing method that address the above issue, the hat-shaped cross-section component that has a hat-shaped cross-section profile is formed by gripping the central portion of the metal sheet with the punch and the pad, gripping the both side portions of the metal sheet with the die and the holder, and moving the holder and die, and the punch and pad, up-down relative to each other. Then, the pressure limiting section is interposed between the pad and the holder, and one or both out of the die or the blank holder are moved in a demolding direction in a state in which pressing on the hat-shaped cross-section component by the pad and the holder is limited. The hat-shaped cross-section component is thereby removed from the mold (the holder, the die, the punch, and the pad) in a state in which pressing of the formed hat-shaped cross-section component between the pad and the holder is limited during demolding.

Advantageous Effects of Invention

The hat-shaped cross-section component manufacturing apparatus and manufacturing method of the present invention exhibit the excellent advantageous effect of enabling deformation of a hat-shaped cross-section component during demolding to be suppressed.

Figure 12A:
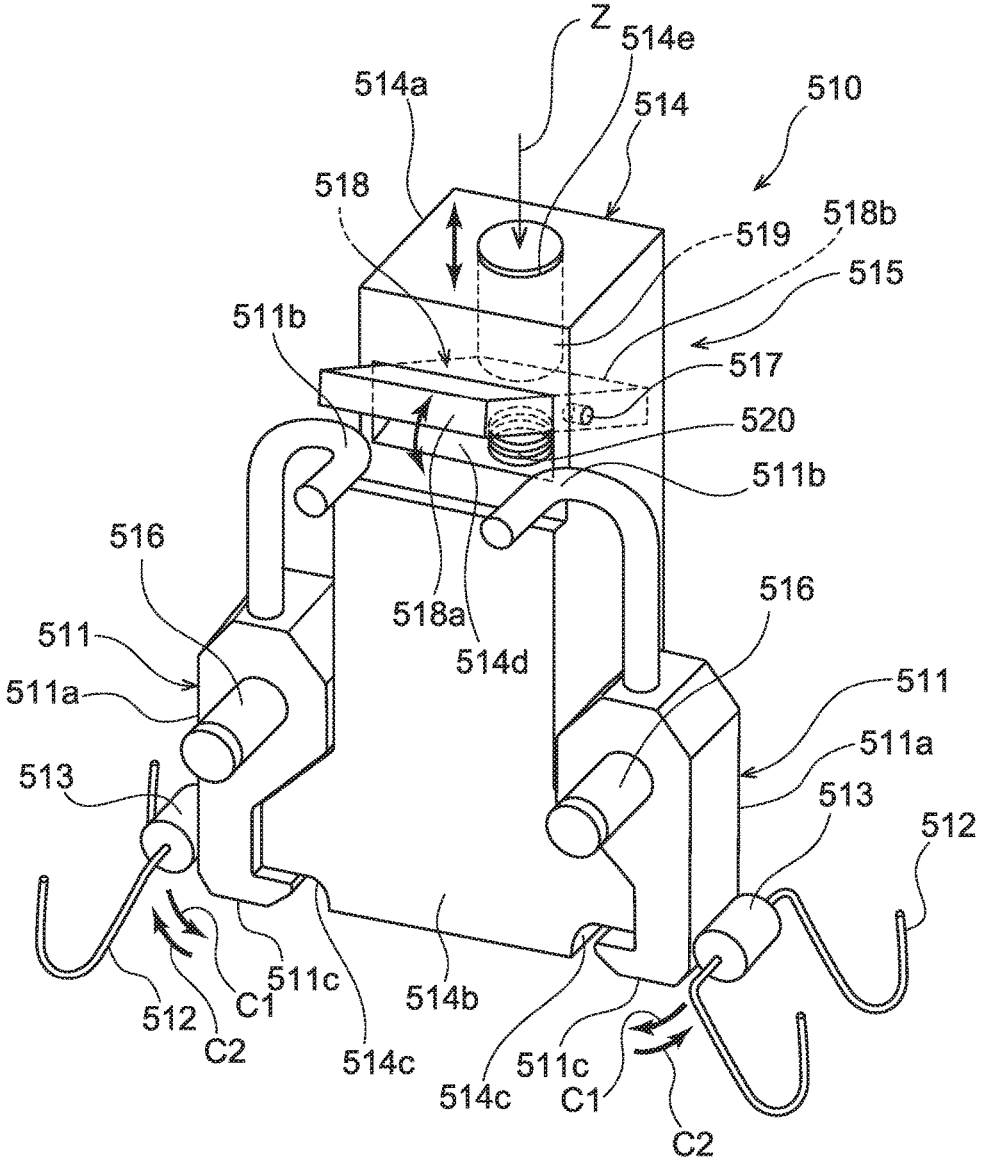
FIG. 12A is a perspective view illustrating a pressure limiting device.
Figure 12B:
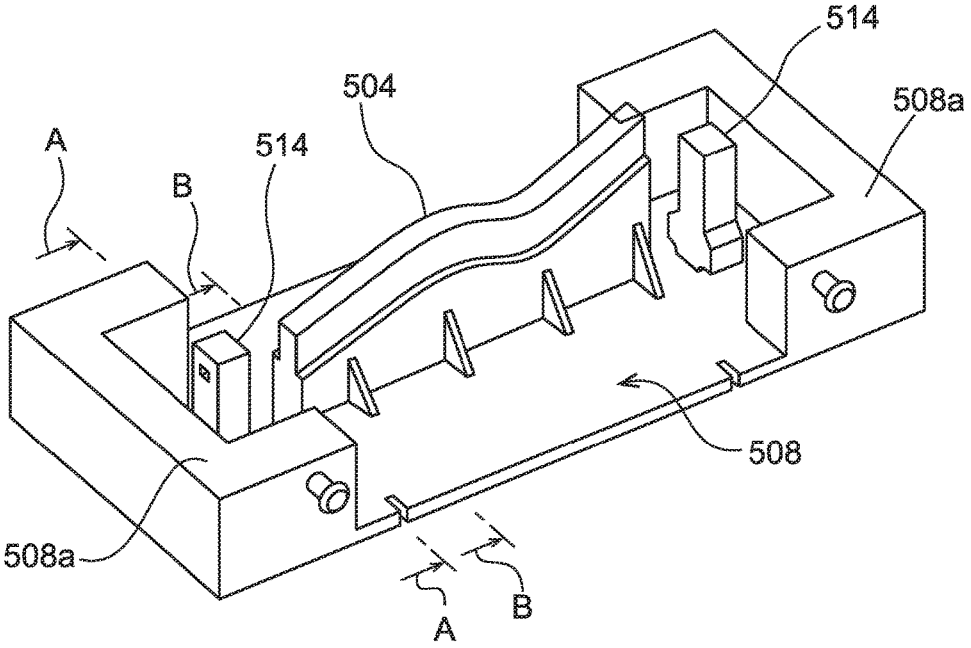
FIG. 12B is a perspective view illustrating a base plate to which a punch is fixed, and floating blocks configuring a portion of a pressure limiting device.
Figure 12C:
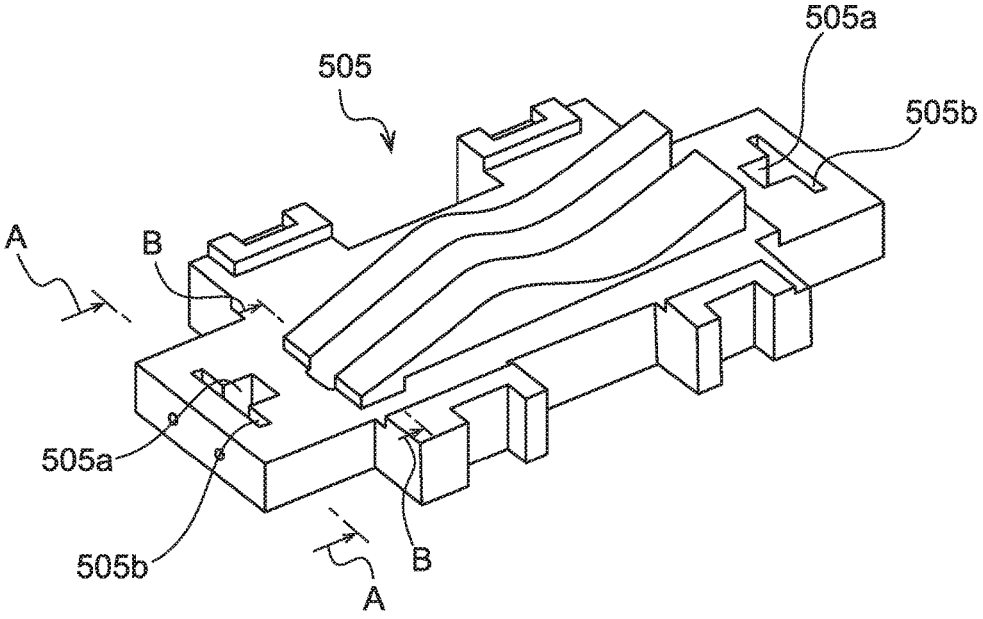
FIG. 12C is a perspective view illustrating a blank holder.
Figure 12D:
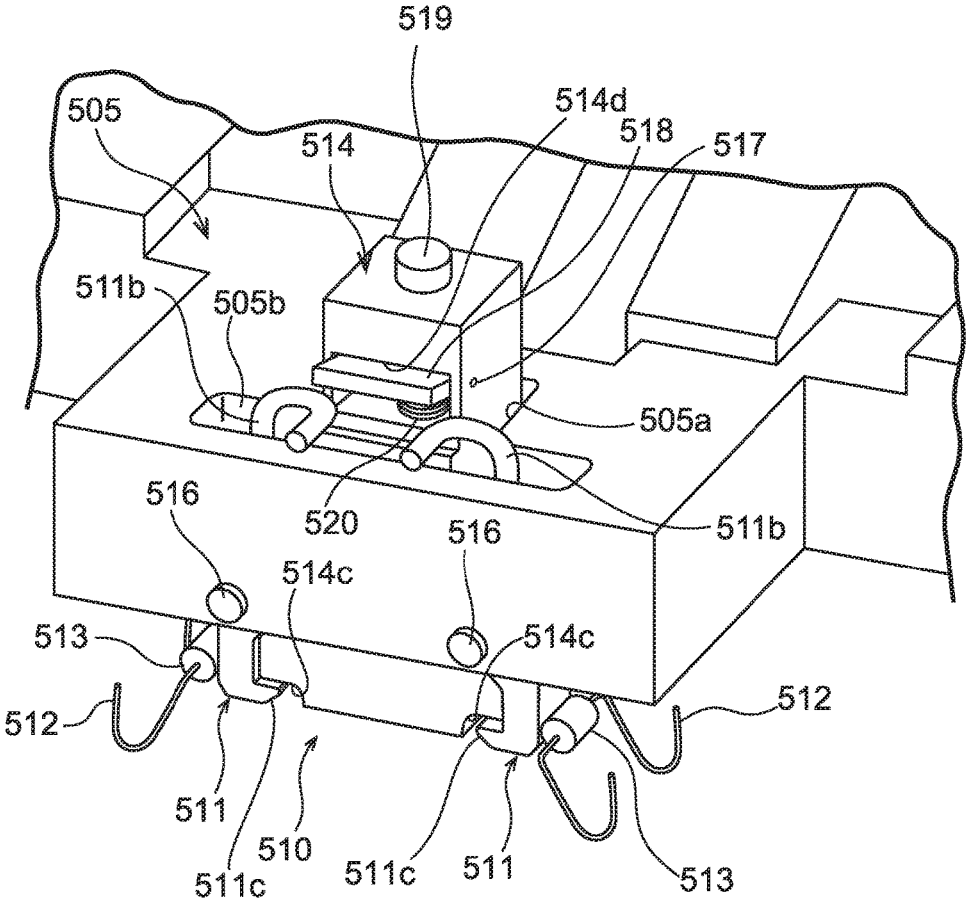
FIG. 12D is a perspective view illustrating floating blocks incorporated into a blank holder.
Figure 12E:
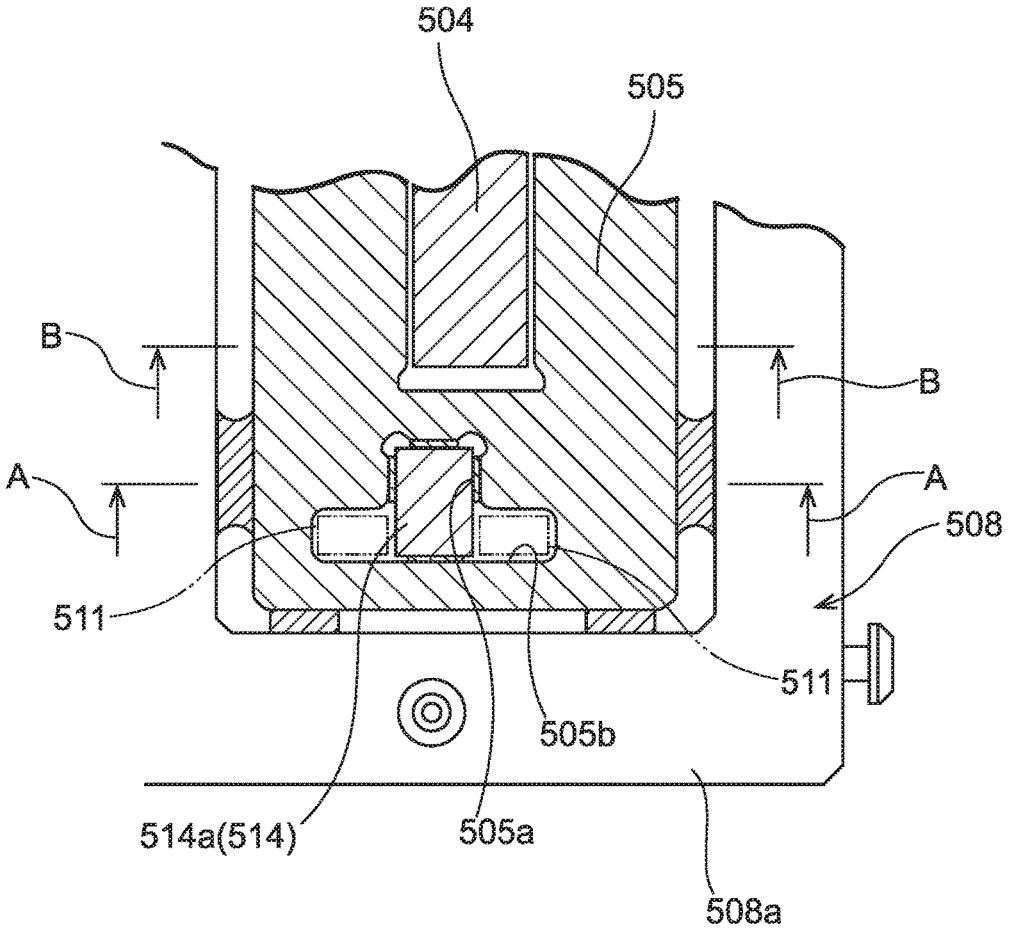
FIG. 12E is a partial plan view cross-section illustrating a location where a pressure limiting device is provided in a hat-shaped cross-section component manufacturing apparatus.
Figure 13A:
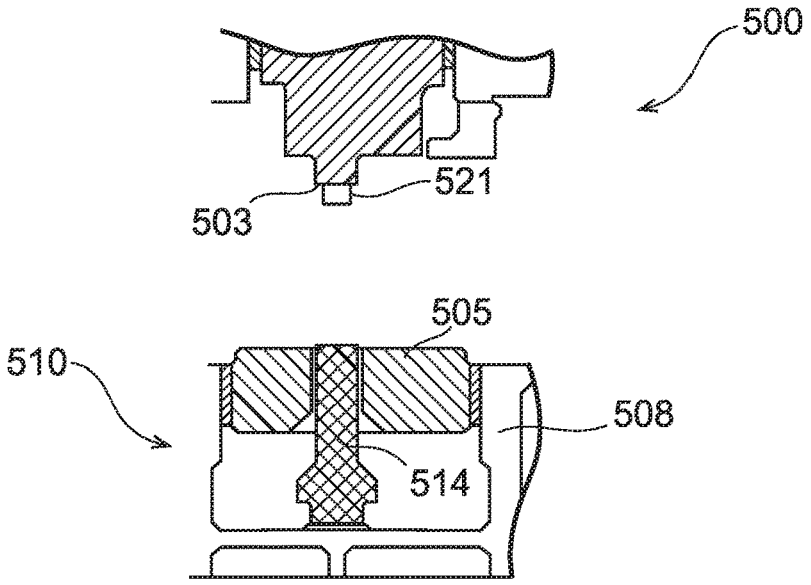
FIG. 13A is an explanatory diagram illustrating a cross-section of a hat-shaped cross-section component manufacturing apparatus over time, as taken along line A-A in FIG. 12B, FIG. 12C, and FIG. 12E.
Figure 13B:
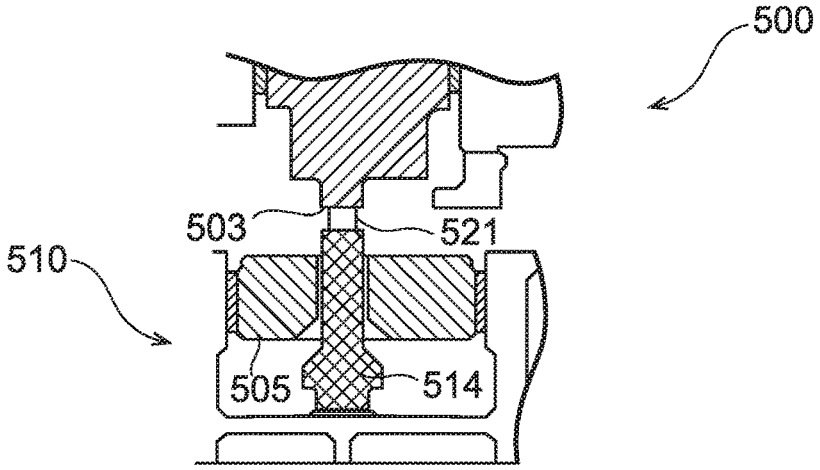
FIG. 13B is an explanatory diagram illustrating a cross-section of a hat-shaped cross-section component manufacturing apparatus over time, as taken along line A-A in FIG. 12B, FIG. 12C, and FIG. 12E, illustrating the cross-section at a later timing than in FIG. 13A.
Figure 13C:
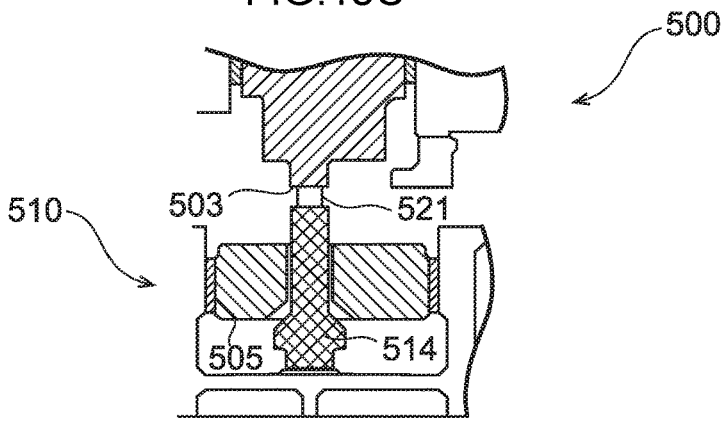
FIG. 13C is an explanatory diagram illustrating a cross-section of a hat-shaped cross-section component manufacturing apparatus over time, as taken along line A-A in FIG. 12B, FIG. 12C, and FIG. 12E, illustrating the cross-section at a later timing than in FIG. 13B.
Figure 13D:
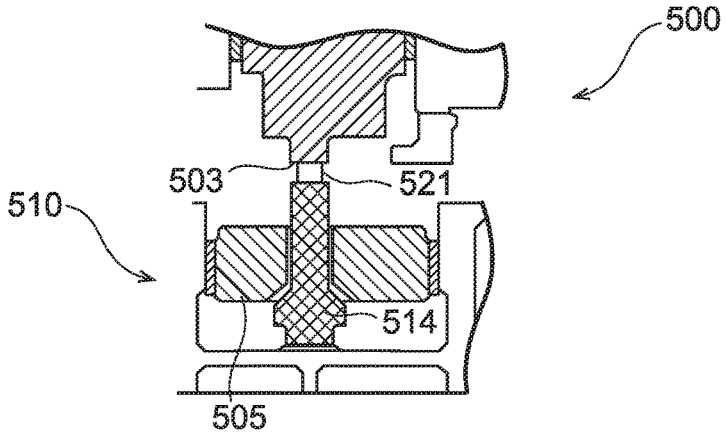
FIG. 13D is an explanatory diagram illustrating a cross-section of a hat-shaped cross-section component manufacturing apparatus over time, as taken along line A-A in FIG. 12B, FIG. 12C, and FIG. 12E, illustrating the cross-section at a later timing than in FIG. 13C.
Figure 13E:
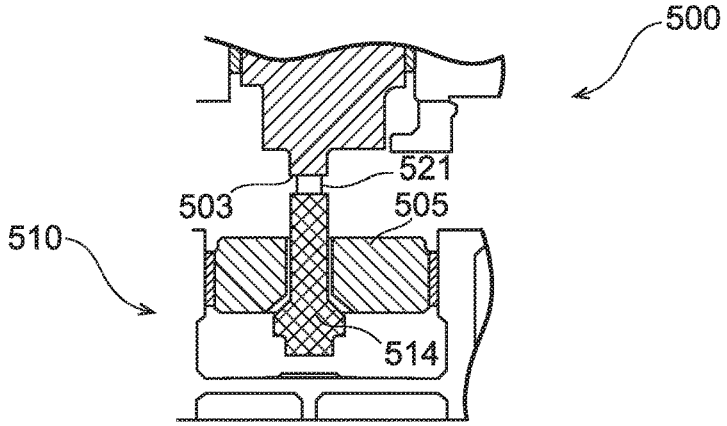
FIG. 13E is an explanatory diagram illustrating a cross-section of a hat-shaped cross-section component manufacturing apparatus over time, as taken along line A-A in FIG. 12B, FIG. 12C, and FIG. 12E, illustrating the cross-section at a later timing than in FIG. 13D.
Figure 13F:
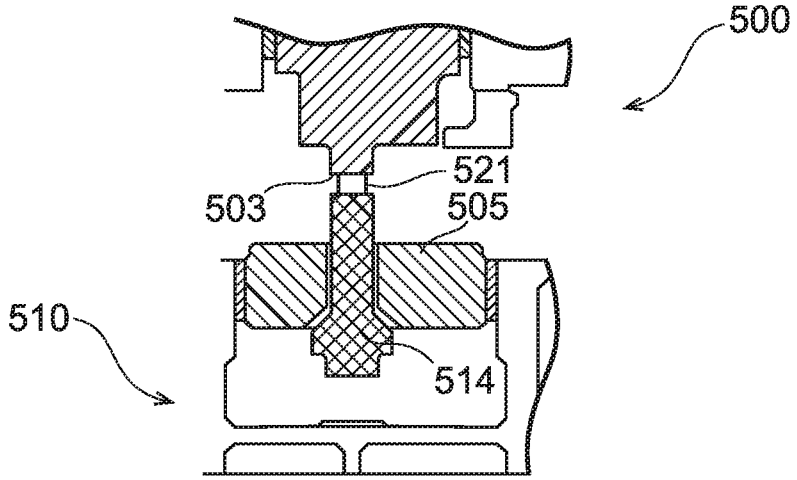
FIG. 13F is an explanatory diagram illustrating a cross-section of a hat-shaped cross-section component manufacturing apparatus over time, as taken along line A-A in FIG. 12B, FIG. 12C, and FIG. 12E, illustrating the cross-section at a later timing than in FIG. 13E.

12B, FIG. 12C, and FIG. 12E, illustrating the cross-section at the same timing as in FIG. 13F.

Figure 13G:
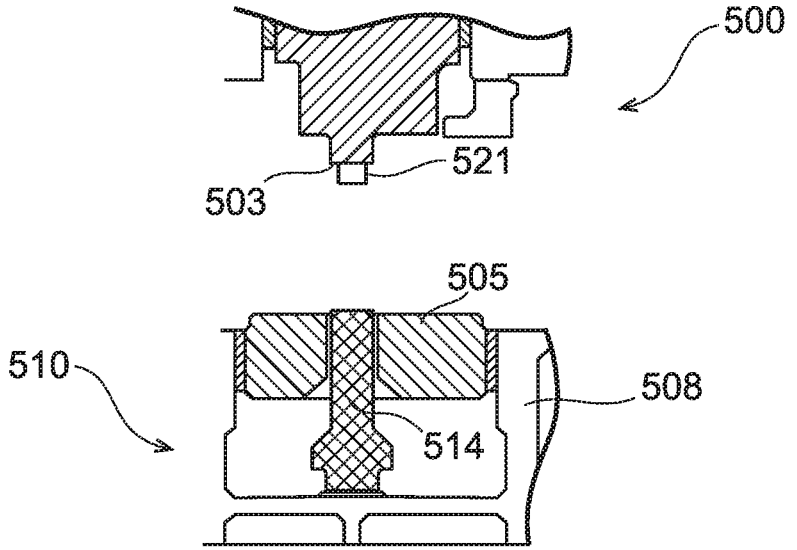
FIG. 13G is an explanatory diagram illustrating a cross-section of a hat-shaped cross-section component manufacturing apparatus over time, as taken along line A-A in FIG. 12B, FIG. 12C, and FIG. 12E, illustrating the cross-section at a later timing than in FIG. 13F.
Figure 14A:
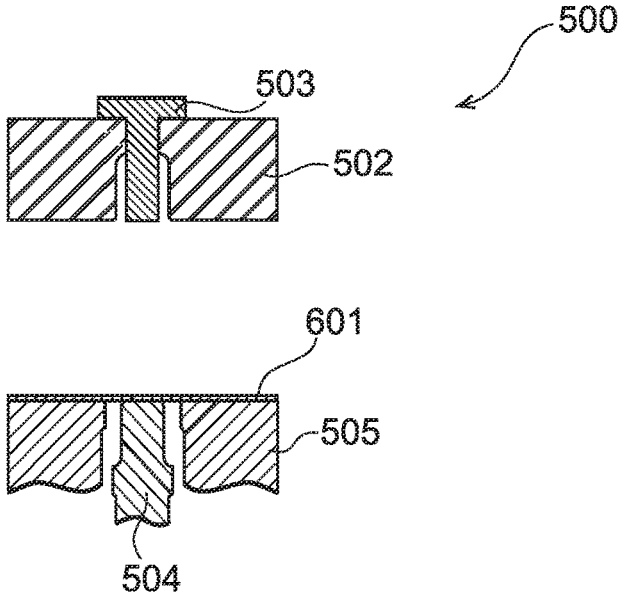
FIG. 14A is an explanatory diagram illustrating a cross-section of a hat-shaped cross-section component manufacturing apparatus over time, as taken along line B-B in FIG. 12B, FIG. 12C, and FIG. 12E, illustrating the cross-section at the same timing as in FIG. 13A.
Figure 14B:
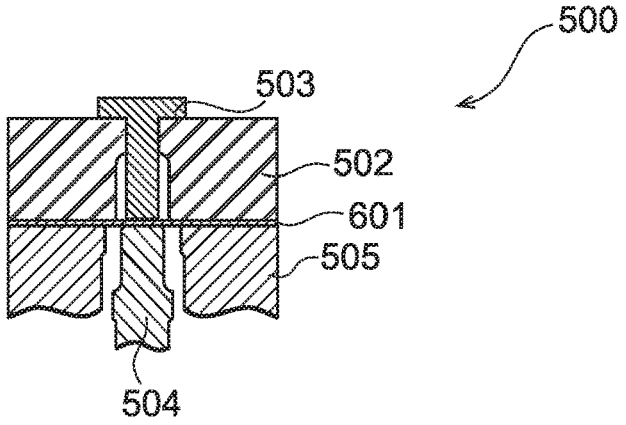
FIG. 14B is an explanatory diagram illustrating a cross-section of a hat-shaped cross-section component manufacturing apparatus over time, as taken along line B-B in FIG. 12B, FIG. 12C, and FIG. 12E, illustrating the cross-section at the same timing as in FIG. 13B.
Figure 14C:
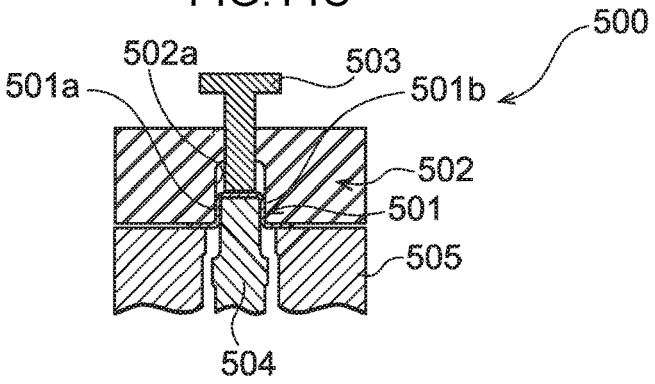
FIG. 14C is an explanatory diagram illustrating a cross-section of a hat-shaped cross-section component manufacturing apparatus over time, as taken along line B-B in FIG. 12B, FIG. 12C, and FIG. 12E, illustrating the cross-section at the same timing as in FIG. 13C.
Figure 14D:
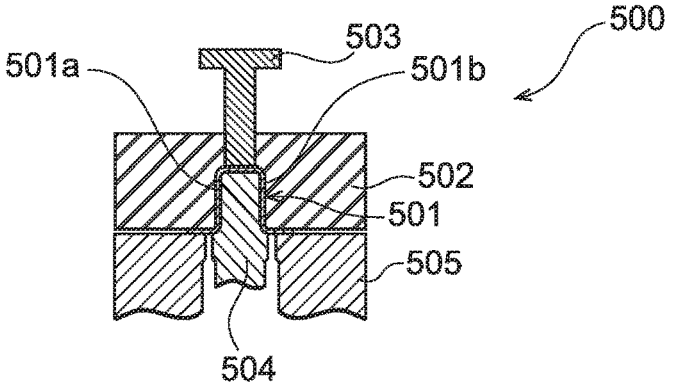
FIG. 14D is an explanatory diagram illustrating a cross-section of a hat-shaped cross-section component manufacturing apparatus over time, as taken along line B-B in FIG. 12B, FIG. 12C, and FIG. 12E, illustrating the cross-section at the same timing as in FIG. 13D.
Figure 14E:
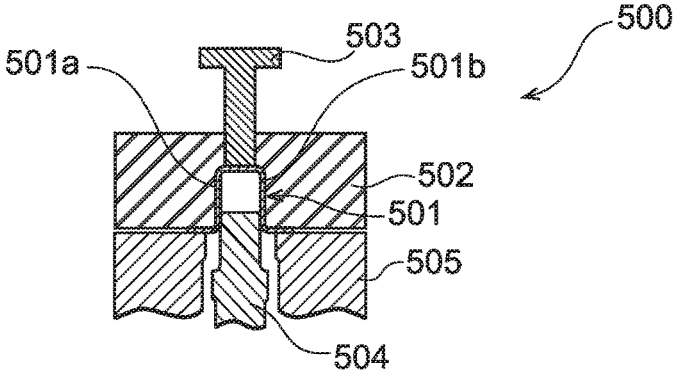
FIG. 14E is an explanatory diagram illustrating a cross-section of a hat-shaped cross-section component manufacturing apparatus over time, as taken along line B-B in FIG. 12B, FIG. 12C, and FIG. 12E, illustrating the cross-section at the same timing as in FIG. 13E.
Figure 14F:
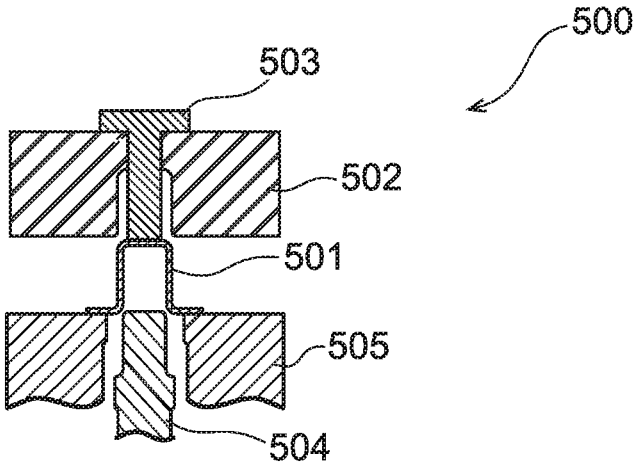
FIG. 14F is an explanatory diagram illustrating a cross-section of a hat-shaped cross-section component manufacturing apparatus over time, as taken along line B-B in FIG.
Figure 14G:
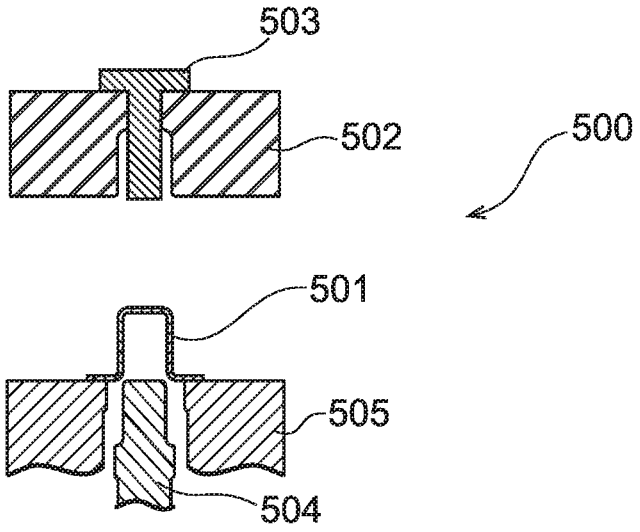

FIG. 14G is an explanatory diagram illustrating a cross-section of a hat-shaped cross-section component manufacturing apparatus over time, as taken along line B-B in FIG. 12B, FIG. 12C, and FIG. 12E, illustrating the cross-section at the same timing as in FIG. 13G.

Figure 15A:
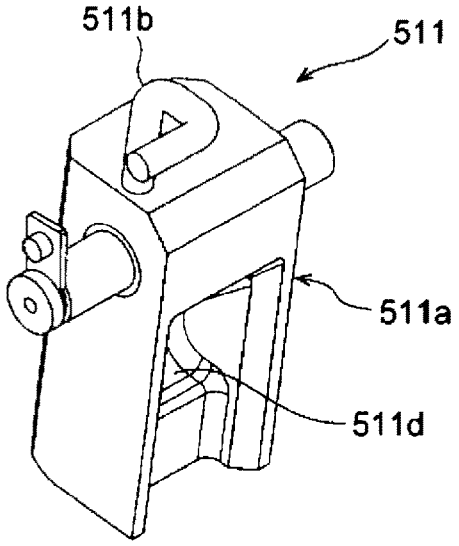

FIG. 15A is a perspective view illustrating a holding arm of another embodiment.

Figure 15B:
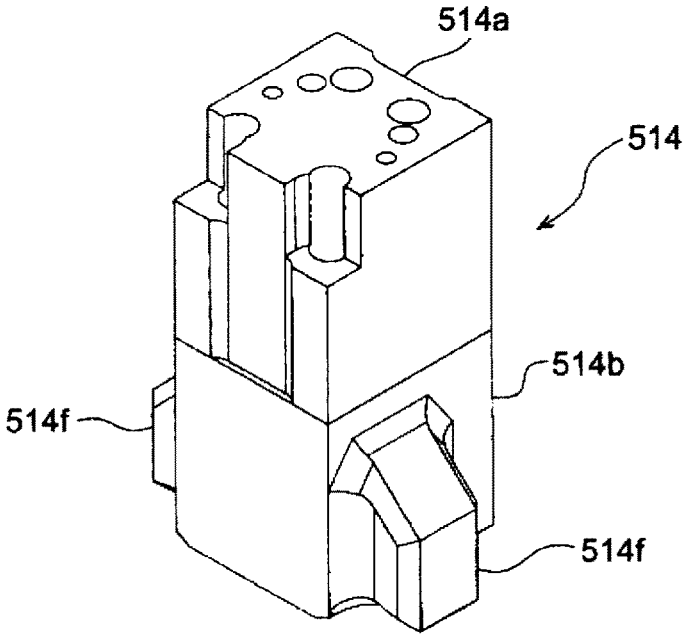

FIG. 15B is a perspective view illustrating floating blocks of another embodiment.

Figure 16A:
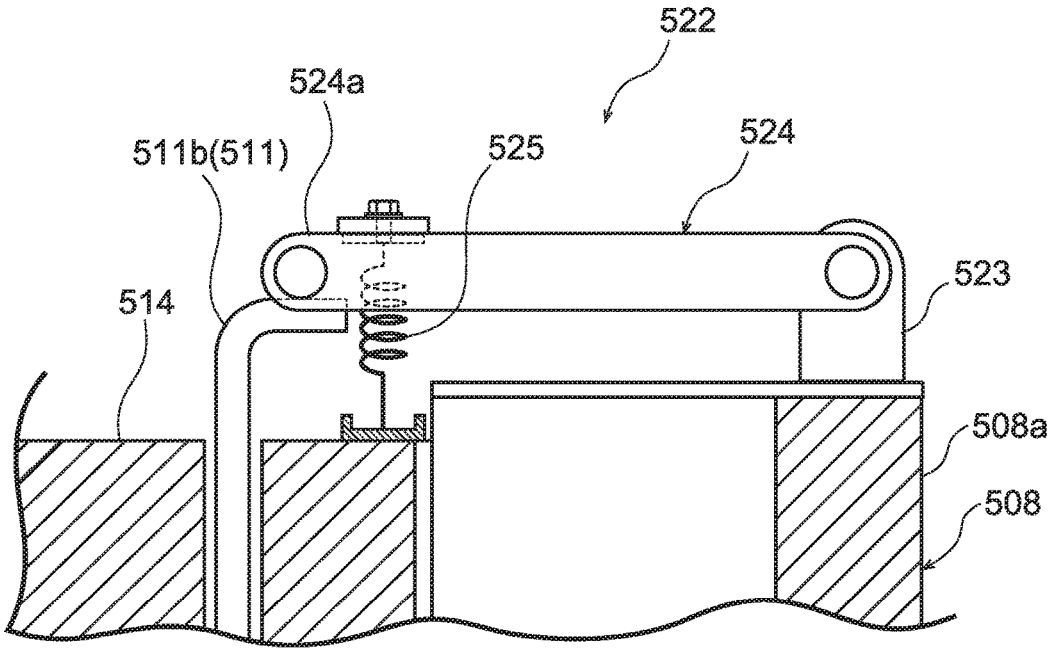

FIG. 16A is a side view illustrating a retention release section provided to the base plate illustrated in FIG. 12B.

Figure 16B:
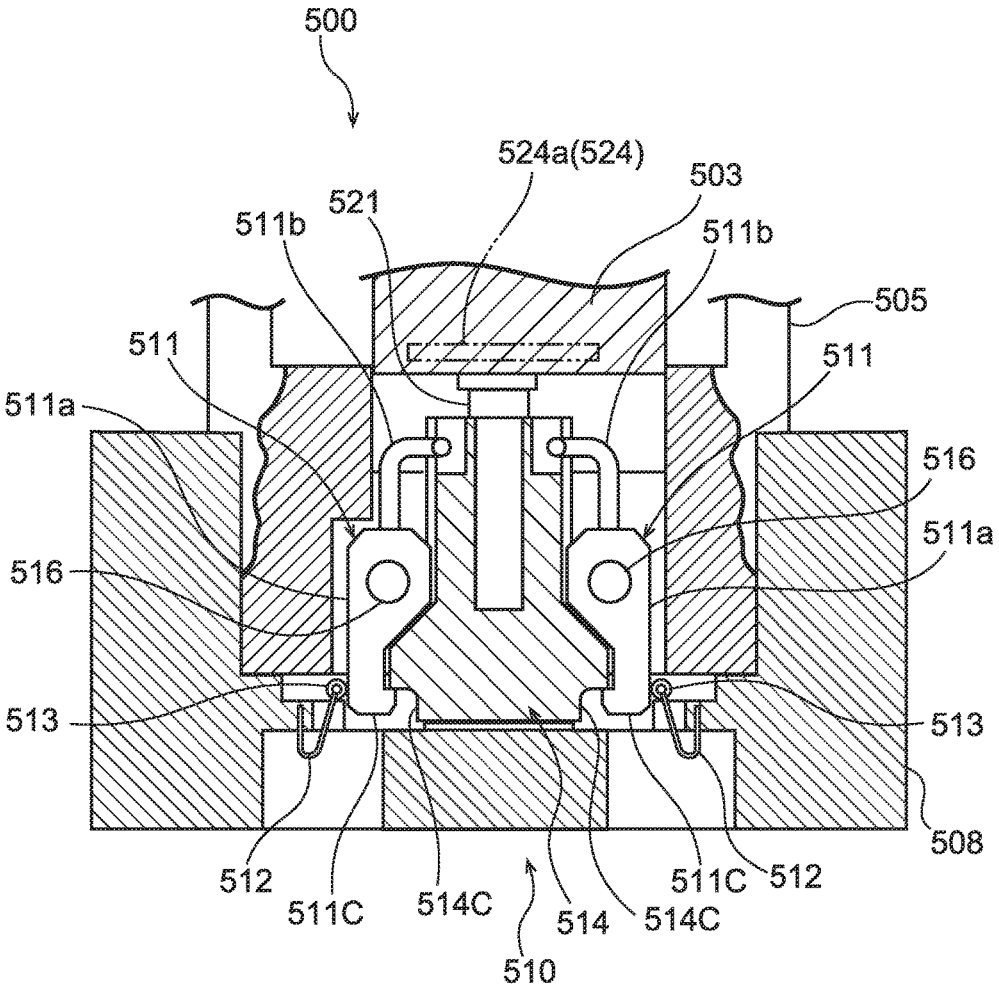

FIG. 16B is an explanatory diagram corresponding to FIG. 13D, illustrating a cross-section of a hat-shaped cross-section component manufacturing apparatus including the retention release section illustrated in FIG. 16A over time.

Figure 16C:
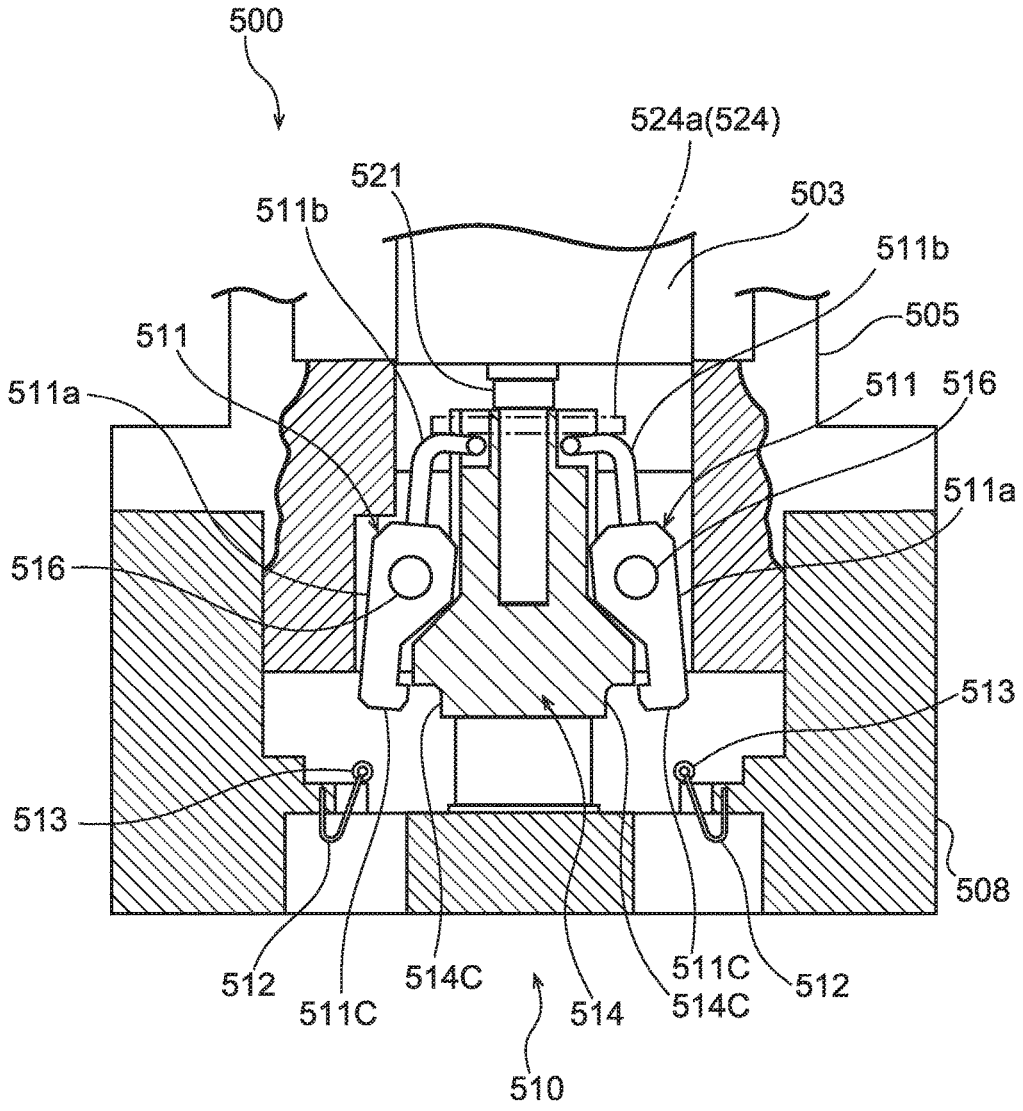

FIG. 16C is an explanatory diagram corresponding to FIG. 13F, illustrating a cross-section of a hat-shaped cross-section component manufacturing apparatus including the retention release section illustrated in FIG. 16A over time.

Figure 16D:
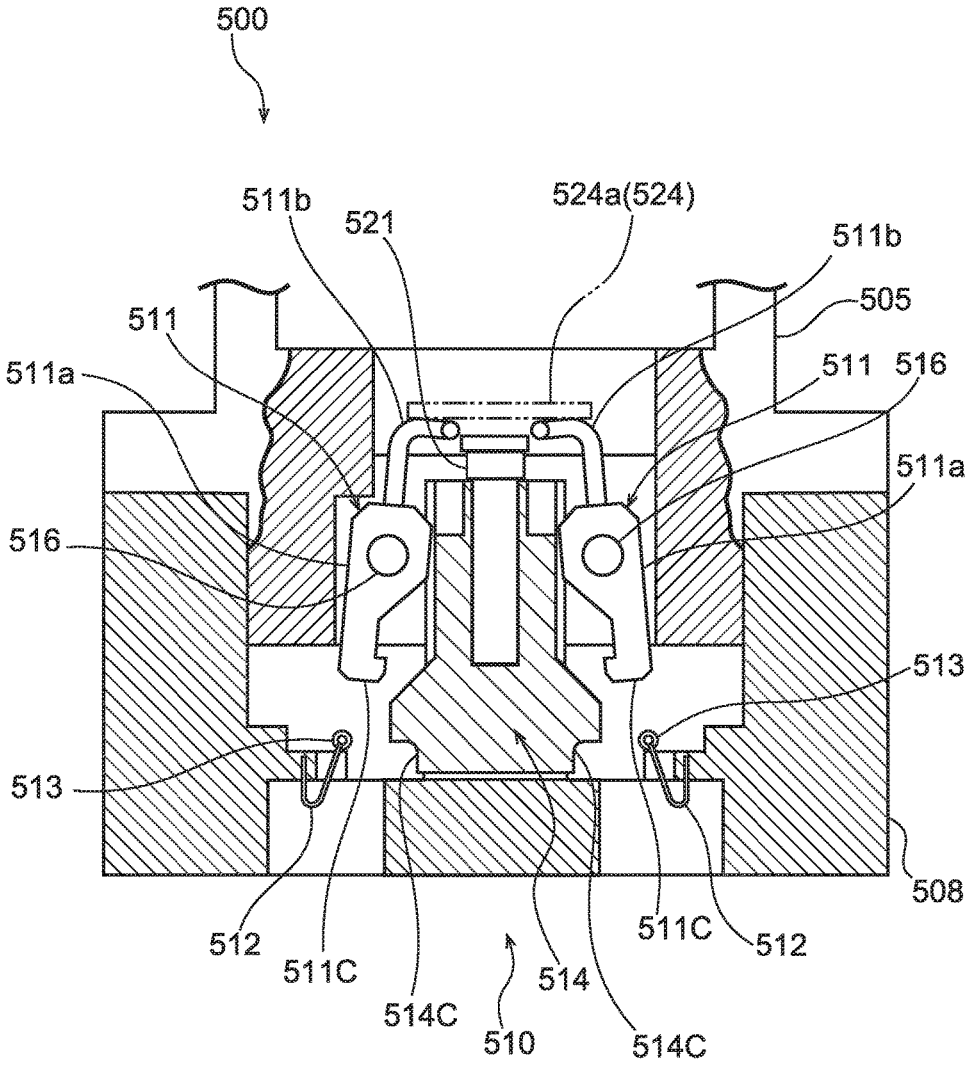

FIG. 16D is an explanatory diagram corresponding to FIG. 13G, illustrating a cross-section of a hat-shaped cross-section component manufacturing apparatus including the retention release section illustrated in FIG. 16A over time.

Figure 17A:
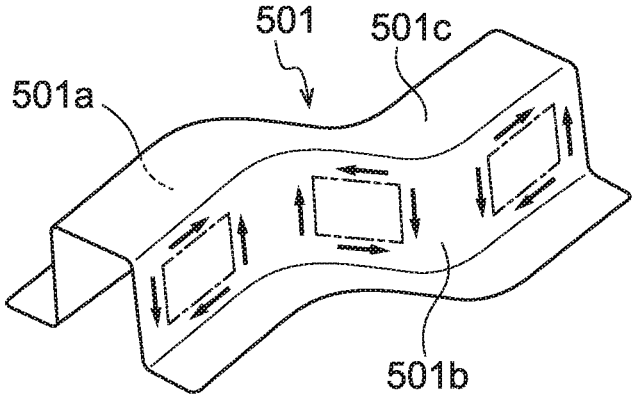

FIG. 17A is a perspective view of a curving component, schematically illustrating stress occurring in vertical walls.

Figure 17B:
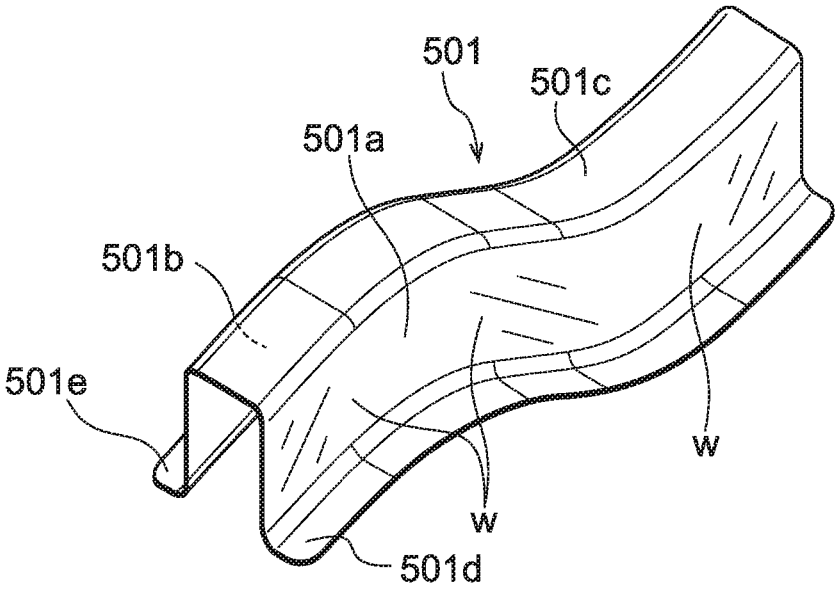

FIG. 17B is a perspective view of the curving component, illustrating shear creasing occurring in the vertical walls.

Figure 17C:
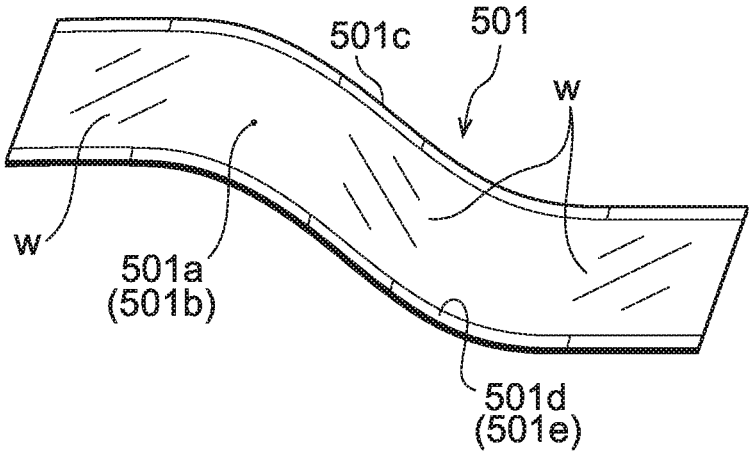

FIG. 17C is a side view of the curving component, illustrating shear creasing occurring in the vertical walls.

Figure 18A:
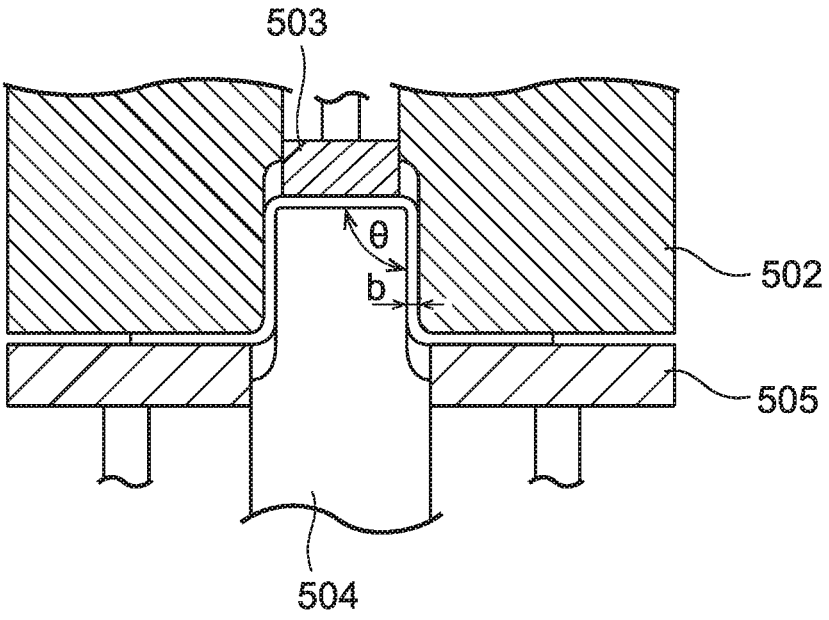

FIG. 18A is a cross-section of a hat-shaped cross-section component manufacturing apparatus to explain the dimensions and the like of respective portions in order to prevent the occurrence of shear creasing.

Figure 18B:
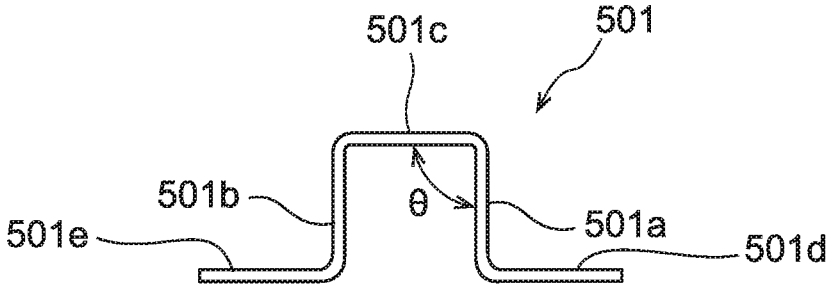

FIG. 18B is a cross-section of a curving component to explain the dimensions and the like of respective portions in order to prevent the occurrence of shear creasing.

Figure 18C:
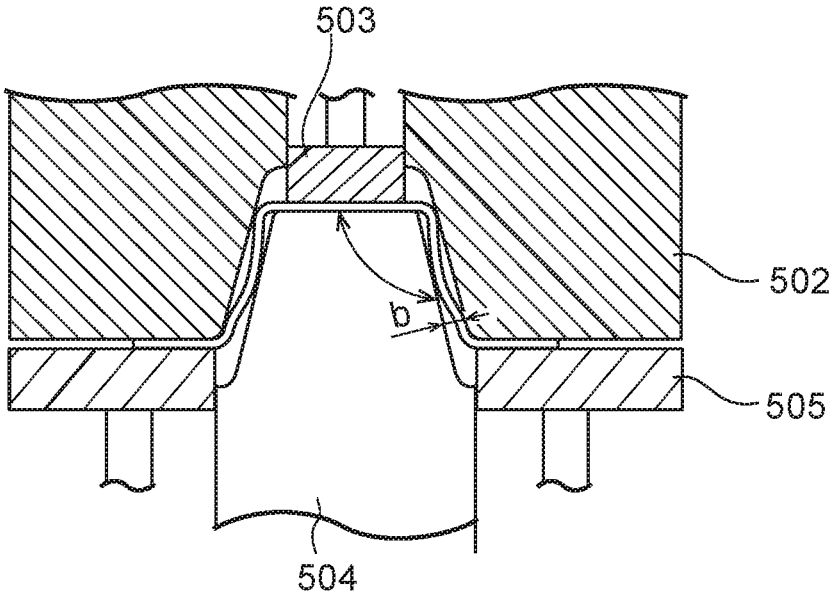

FIG. 18C is a cross-section of a hat-shaped cross-section component manufacturing apparatus to explain the dimensions and the like of respective portions in order to prevent the occurrence of shear creasing.

Figure 18D:
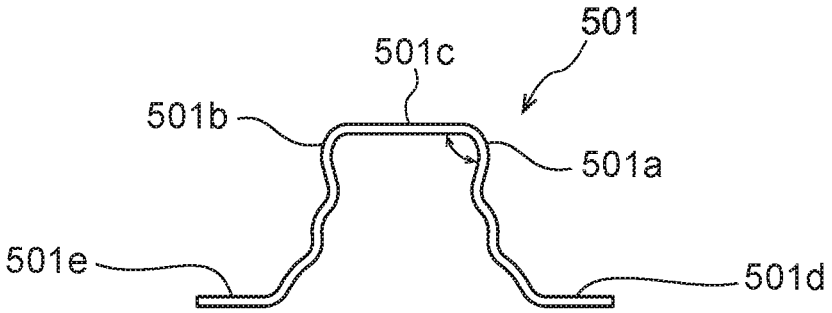

FIG. 18D is cross-section of a curving component to explain the dimensions and the like of respective portions in order to prevent the occurrence of shear creasing.

Figure 5:
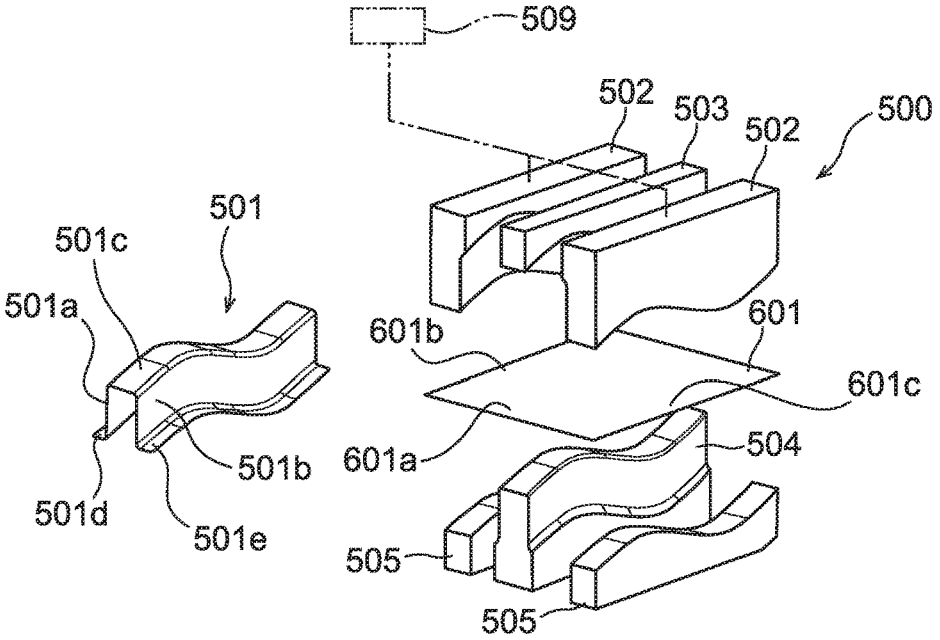
FIG. 5 is an exploded perspective view illustrating relevant portions of a hat-shaped cross-section component manufacturing apparatus.
Figure 19A:
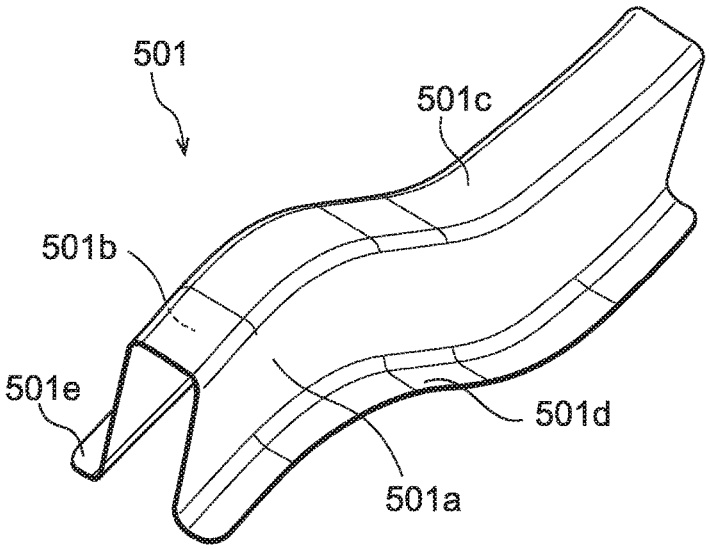

FIG. 19A is a perspective view of a curving component manufactured by the hat-shaped cross-section component manufacturing apparatus illustrated in FIG. 5.

Figure 19B:
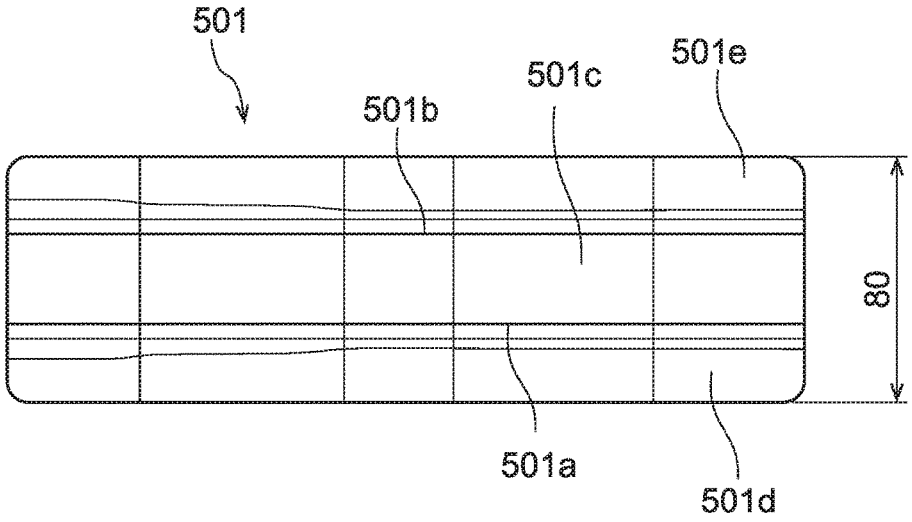

FIG. 19B is a plan view of the curving component illustrated in FIG. 19A, as viewed from above.

Figure 19C:
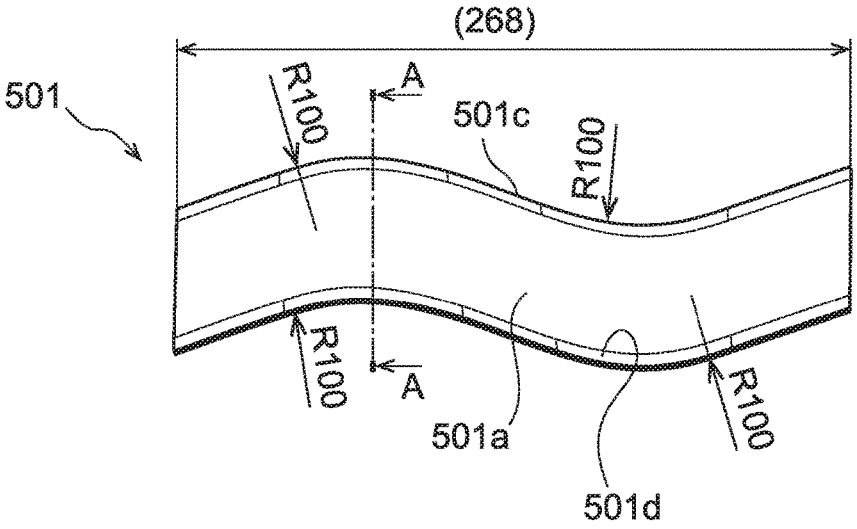

FIG. 19C is a side view of the curving component illustrated in FIG. 19A.

Figure 19D:
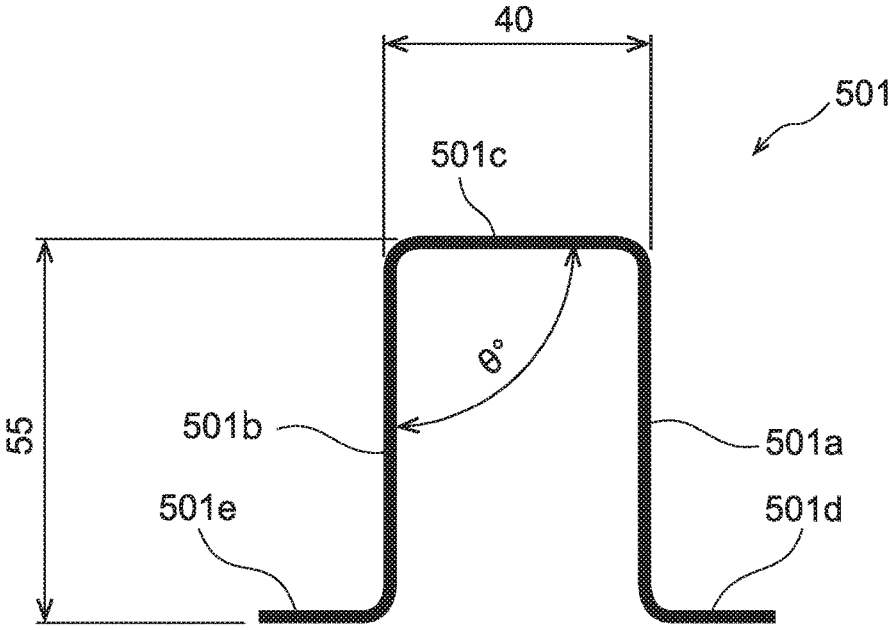

FIG. 19D is a front view of the curving component illustrated in FIG. 19A, as viewed from one end portion.

Figure 20:
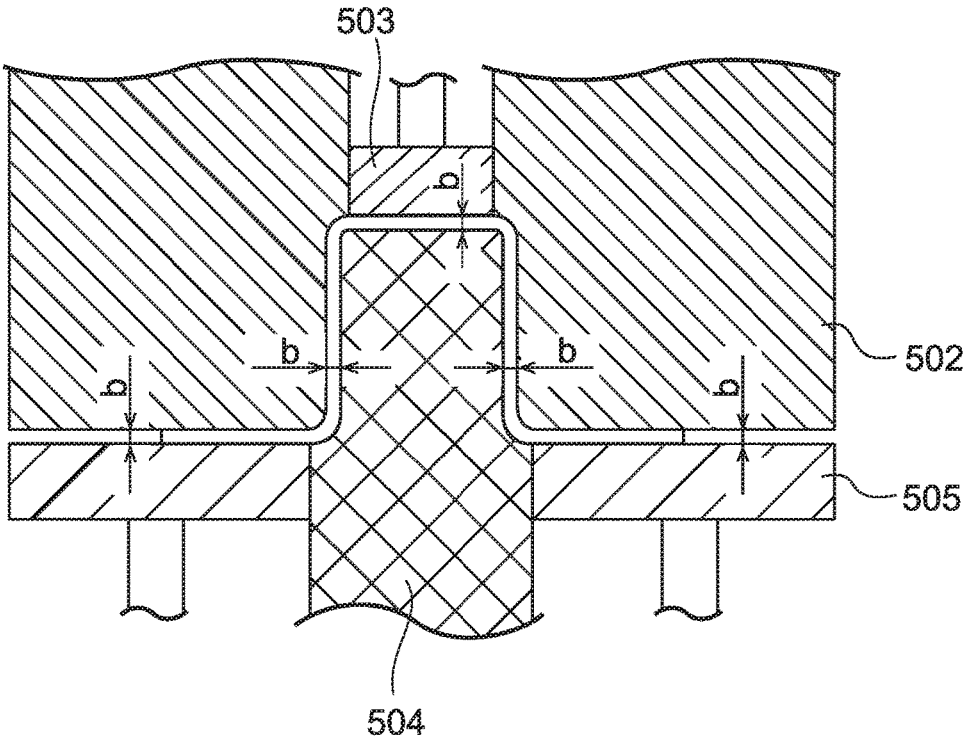

FIG. 20 is a cross-section of a mold, illustrating the clearance b in Table 1.

DESCRIPTION OF EMBODIMENTS

Explanation follows regarding a hat-shaped cross-section component manufacturing apparatus and manufacturing method according to an exemplary embodiment of the present invention. First, explanation follows regarding configuration of a hat-shaped cross-section component, followed by explanation regarding the hat-shaped cross-section component manufacturing apparatus and manufacturing method.

Hat-Shaped Cross-Section Component Configuration

FIG. 1A to FIG. 1D and FIG. 2 illustrate a curving component 10, serving as a hat-shaped cross-section component manufactured by drawing using a hat-shaped cross-section component manufacturing apparatus 500 (see FIG. 5) of the present exemplary embodiment. As illustrated in these drawings, the curving component 10 includes a top plate 11 extending along the length direction, and vertical walls 12*a*, 12*b*, that respectively bend and extend from both short end direction sides of the top plate 11 toward one side in the thickness direction of the top plate 11. The curving component 10 further includes an outward extending flange 13*a* that bends from an end of the vertical wall 12*a* on the opposite side to the top plate 11, and extends toward the side away from the vertical wall 12*b*, and an outward extending flange 13*b* that bends at an end of the vertical wall 12*b* on the opposite side to the top plate 11, and extends toward the side away from the vertical wall 12*a*.

Ridge lines 14*a*, 14*b* are formed extending along the length direction of the curving component 10 between the top plate 11 and the respective vertical walls 12*a*, 12*b*. Concave lines 15*a*, 15*b* are formed extending along the length direction of the curving component 10 between the respective vertical walls 12*a*, 12*b* and outward extending flanges 13*a*, 13*b*.

The ridge lines 14*a*, 14*b* and the concave lines 15*a*, 15*b* are provided extending substantially parallel to each other. Namely, the height of the vertical walls 12*a*, 12*b* from the respective outward extending flanges 13*a*, 13*b* is substantially uniform along the length direction of the curving component 10.

Figure 1A:
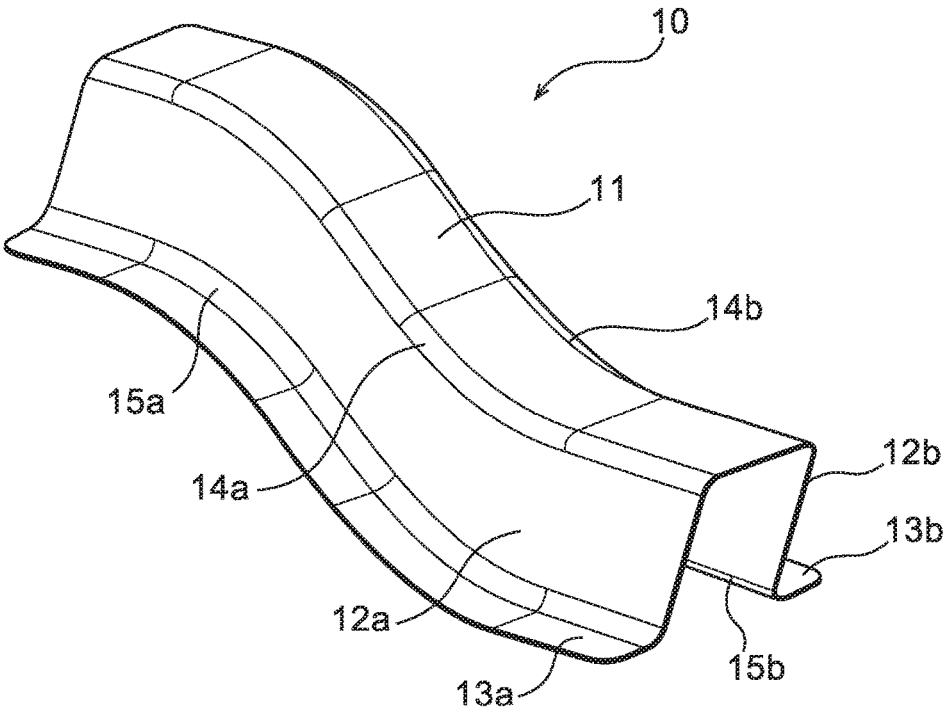
FIG. 1A is a perspective view illustrating an example of a curving component configured with a hat-shaped cross-section.
Figure 1B:
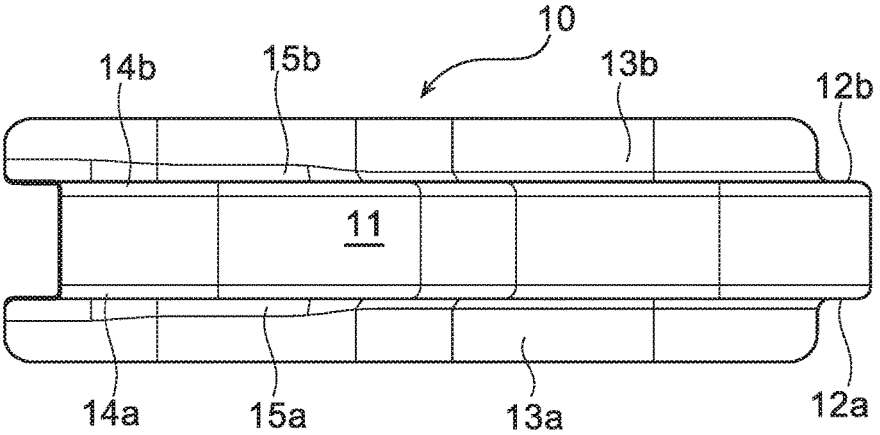
FIG. 1B is a plan view of the curving component illustrated in FIG. 1A, as viewed from above.
Figure 1C:
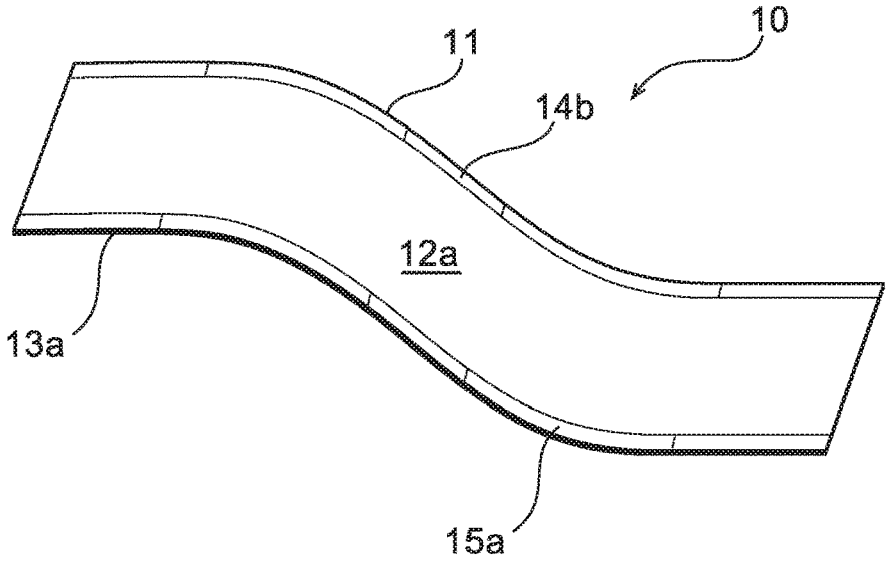
FIG. 1C is a front view of the curving component illustrated in FIG. 1A.
Figure 1D:
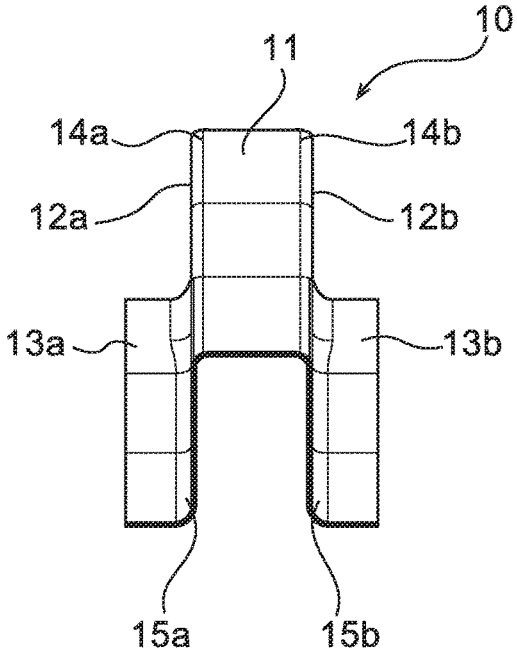
FIG. 1D is a side view of the curving component illustrated in FIG. 1A, as viewed from one end portion.
Figure 2:
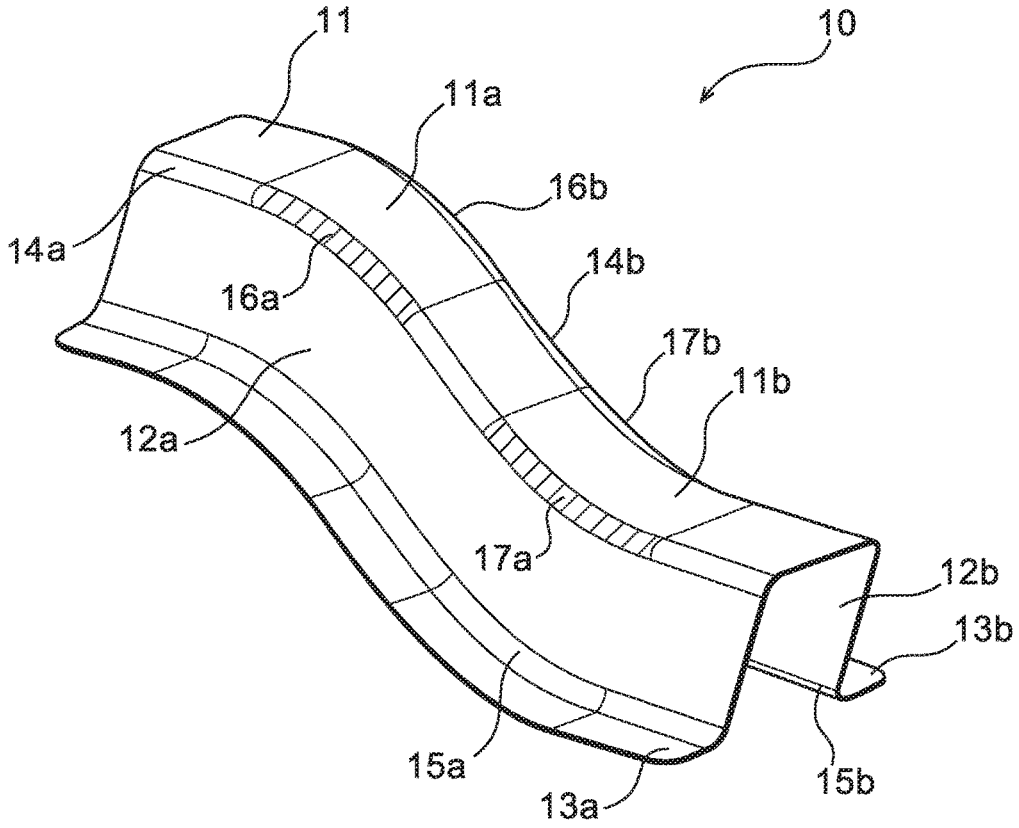
FIG. 2 is a perspective view corresponding to FIG. 1A, illustrating a curving component in order to explain ridge lines at locations corresponding to a concave shaped curved portion and a convex shaped curved portion.

As illustrated in FIG. 2, a portion of the top plate 11 is formed with a convex shaped curved portion 11*a* that curves in an arc shape toward the outside of the lateral cross-section profile of the hat shape, namely toward the outer surface side of the top plate 11. Another portion of the top plate 11 is formed with a concave shaped curved portion 11*b* that curves in an arc shape toward the inside of the lateral cross-section profile of the hat shape, namely toward the inner surface side of the top plate 11. The ridge lines 14*a*, 14*b* formed by the top plate 11 and the vertical walls 12*a*, 12*b* at the convex shaped curved portion 11*a* and the concave shaped curved portion 11*b* are also curved in arc shapes at locations 16*a*, 16*b*, and 17*a*, 17*b*, corresponding to the convex shaped curved portion 11*a* and the concave shaped curved portion 11*b*. Note that an "arc shape" is not limited to part of a perfect circle, and may be part of another curved line, such as of an ellipse, a hyperbola, or a sine wave.

Figure 3A:
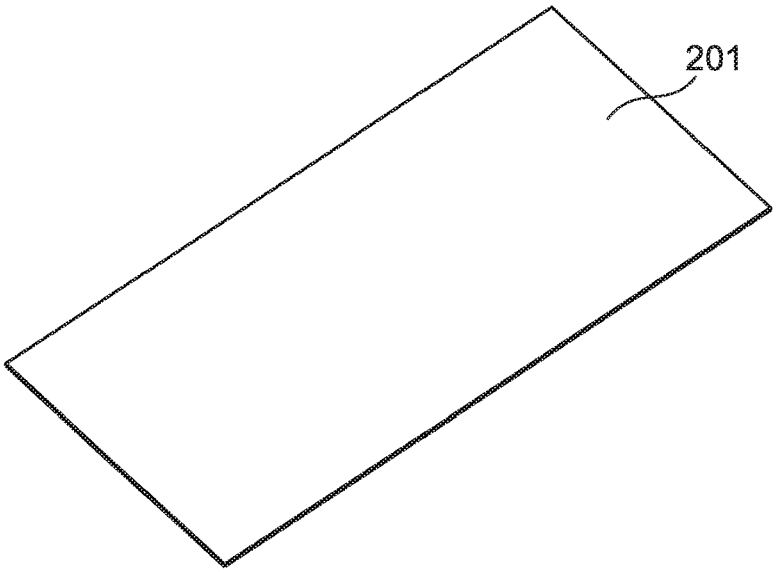
FIG. 3A is a perspective view illustrating a metal stock sheet before forming.
Figure 3B:
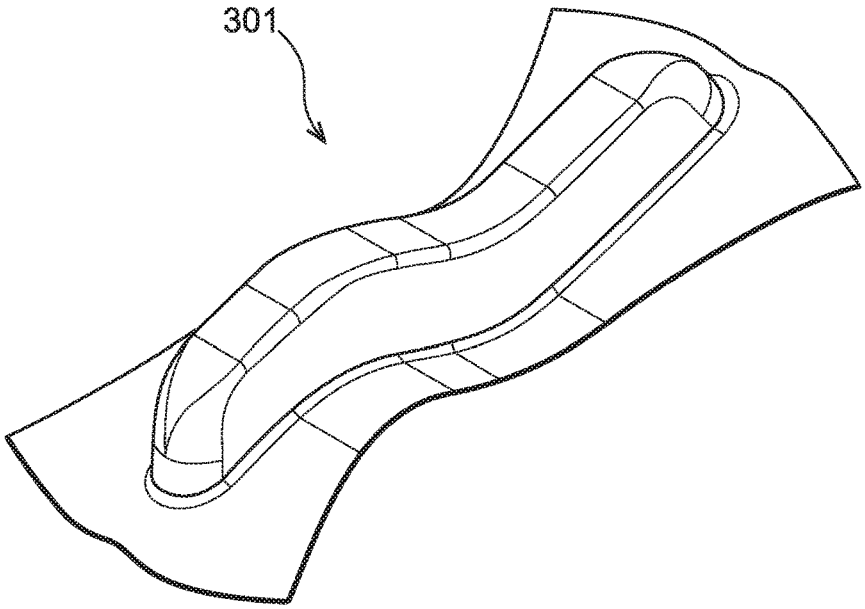
FIG. 3B is a perspective view illustrating a drawn panel.

The curving component 10 described above is formed by forming a drawn panel 301, illustrated in FIG. 3B, by drawing a rectangular shaped metal stock sheet 201, serving as a metal sheet, illustrated in FIG. 3A, and then trimming unwanted portions of the drawn panel 301.

Figure 4:
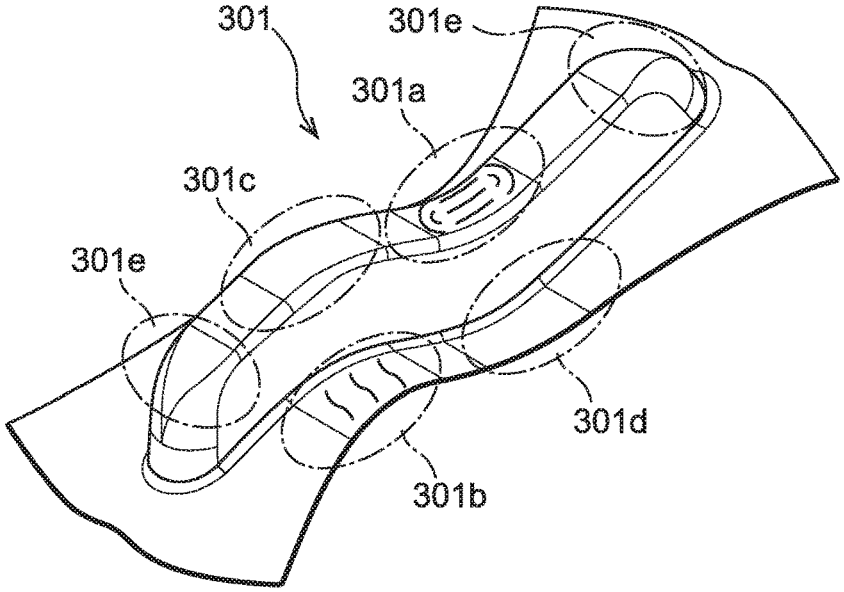
FIG. 4 is a perspective view corresponding to FIG. 3B, illustrating locations in the drawn panel where cracks and creases are liable to occur.

Incidentally, when the curving component 10 with a hat-shaped cross-section is manufactured by drawing, as illustrated in FIG. 4, excess material is present at a concave shaped curved portion top plate 301*a* and a convex shaped curved portion flange 301*b* of the drawn panel 301 at the stage of forming the drawn panel 301, and creases are liable to occur. Increasing restraint at the periphery of the metal stock sheet 201 during the forming process by, for example, raising the pressing force of a blank holder, or by adding locations for forming draw beads to the blank holder, thereby suppressing inflow of the metal stock sheet 201 into the blank holder, is known to be effective in suppressing the occurrence of creases.

However, when there is increased suppression of inflow of the metal stock sheet 201 into the blank holder, there is a large reduction in the sheet thickness of the drawn panel 301 at respective portions including a convex shaped curved portion top plate 301*c*, a concave shaped curved portion flange 301*d*, and both length direction end portions 301*e*, 301*e*. In examples in which the metal stock sheet 201 is a material with particularly low extensibility (for example high tensile steel), it is conceivable that cracking could occur at these respective portions.

Accordingly, in order not to allow creasing and cracking in the manufacture of curved components with a hat-shaped cross-section, such as front side members configuring part of a vehicle body framework, by pressing using drawing, it has been difficult to employ high strength materials with low extensibility as the metal stock sheet 201, meaning that low strength materials with high extensibility have had to be employed.

However, the occurrence of such creasing and cracking can be suppressed through a curving component manufacturing process, described later, employing the hat-shaped cross-section component manufacturing apparatus 500 of the present exemplary embodiment.

Hat-Shaped Cross-Section Component Manufacturing Apparatus Configuration

Figure 6A:
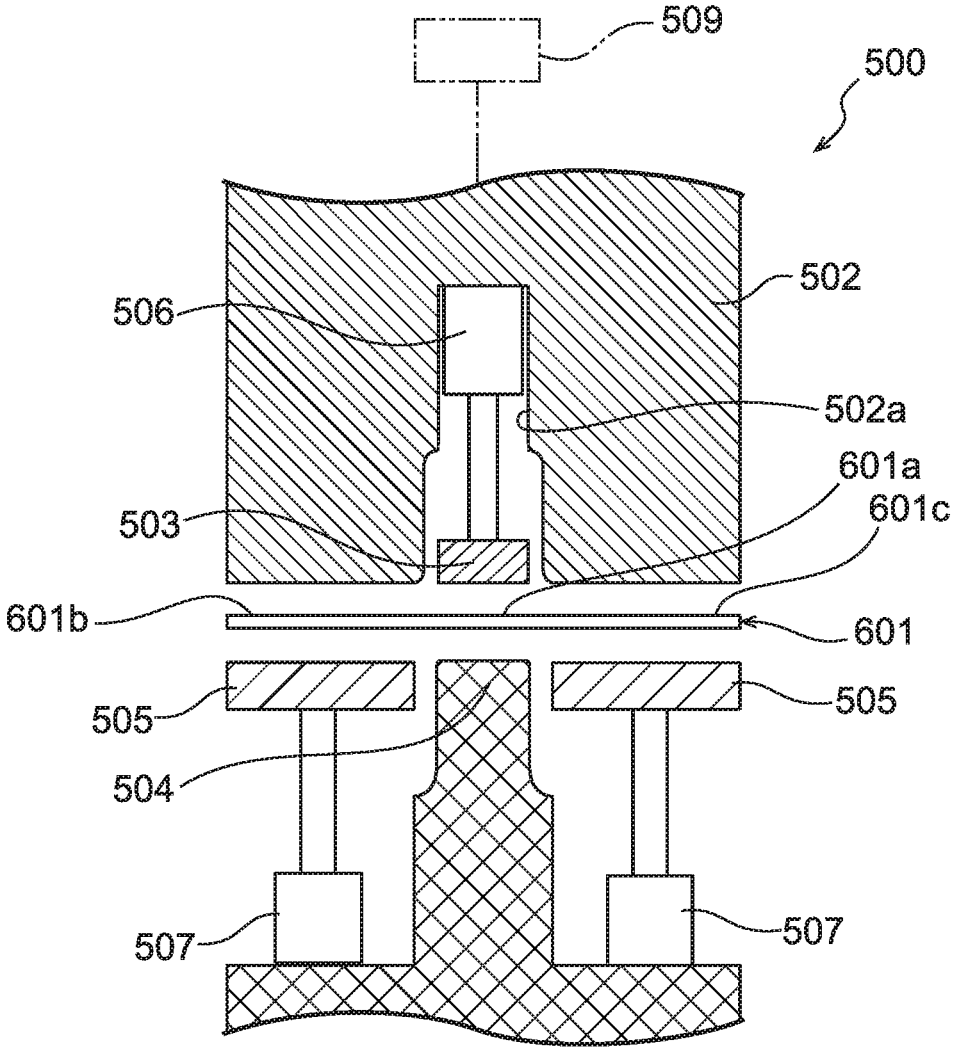
FIG. 6A is a cross-section illustrating a stage at the start of processing of the hat-shaped cross-section component manufacturing apparatus illustrated in FIG. 5.
Figure 6B:
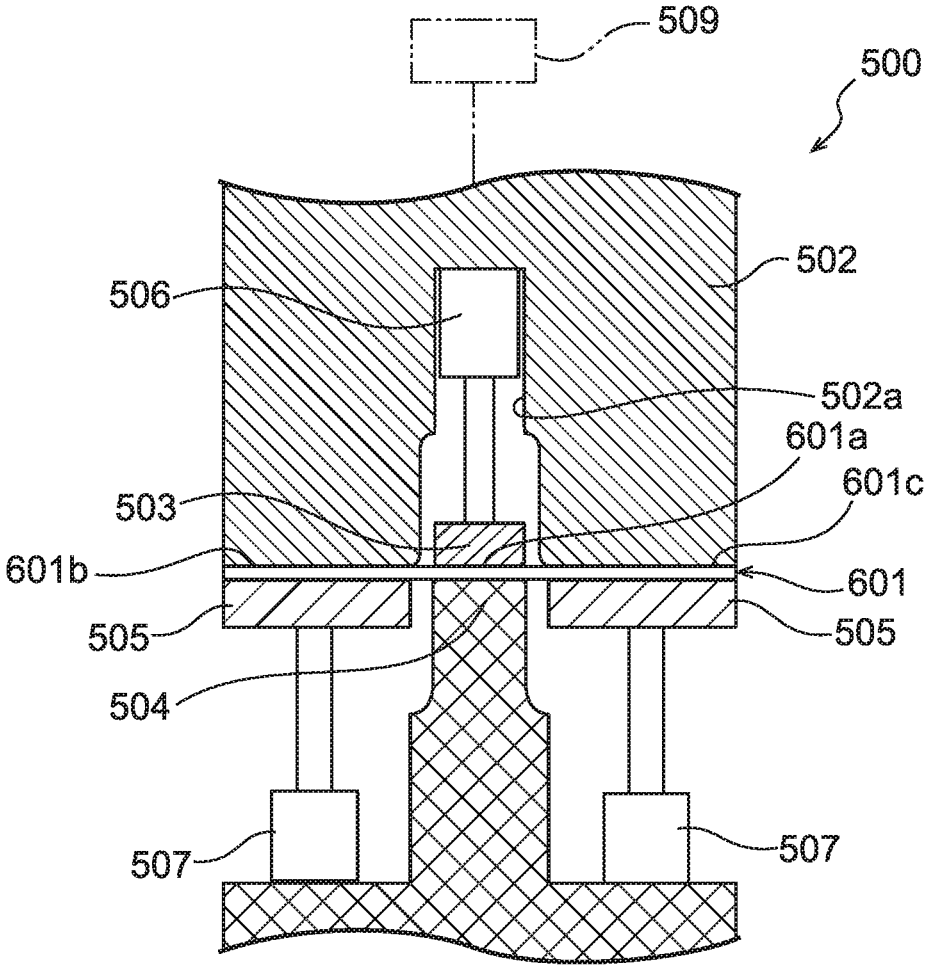
FIG. 6B is a cross-section illustrating the hat-shaped cross-section component manufacturing apparatus illustrated in FIG. 5 at a stage at which a metal stock sheet is gripped and restrained between a die and pad, and a holder and a punch.
Figure 6C:
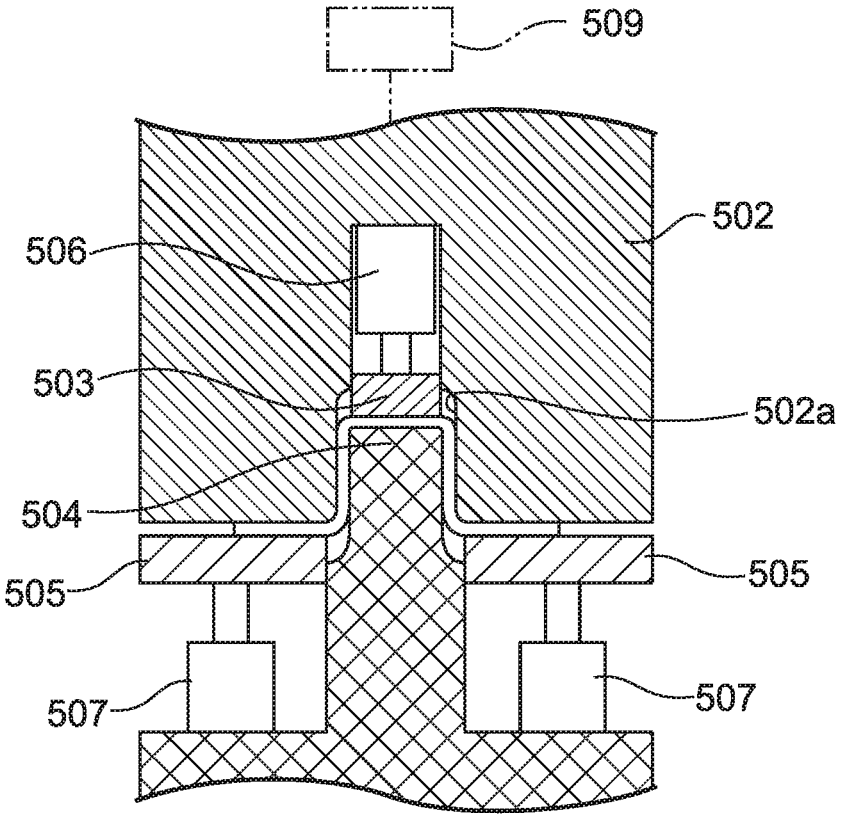
FIG. 6C is a cross-section illustrating a stage at which the punch has been pushed in from the stage illustrated in FIG. 6B.
Figure 6D:
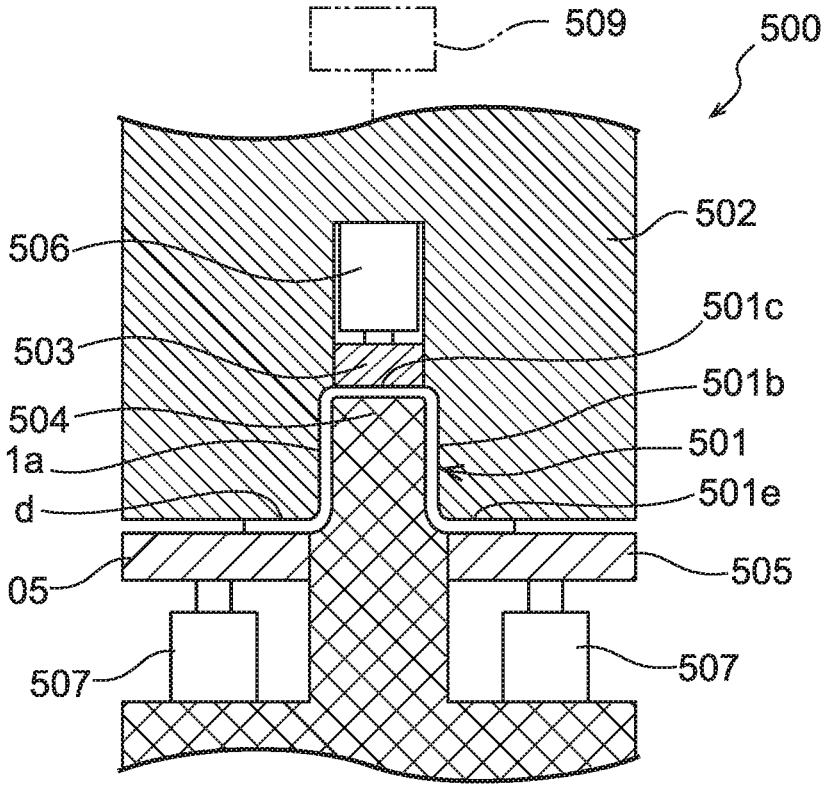
FIG. 6D is a cross-section illustrating a state in which the punch has been pushed in further from the stage illustrated in FIG. 6C, such that the punch has been fully pushed in with respect to the die.

FIG. 5 is an exploded perspective view of the hat-shaped cross-section component manufacturing apparatus 500 employed to manufacture a curving component 501, serving as a hat-shaped cross-section component. Note that configuration of the curving component 501 is substantially the same as the configuration of the curving component 10 (see FIG. 1A). FIG. 6A is a cross-section illustrating the manufacturing apparatus illustrated in FIG. 5 at the start of processing. FIG. 6B is a cross-section illustrating the manufacturing apparatus illustrated in FIG. 5 at a stage at which a metal stock sheet 601 is gripped and restrained between a die 502 and pad 503, and a blank holder 505 and punch 504. FIG. 6C is a cross-section illustrating a stage at which the punch 504 has been pushed in from the stage illustrated in FIG. 6B. FIG. 6D is a cross-section illustrating a state in which the punch 504 has been pushed in further from the stage illustrated in FIG. 6C, such that the punch 504 has been fully pushed in with respect to the die 502.

As illustrated in FIG. 5, the hat-shaped cross-section component manufacturing apparatus 500 includes the die 502 that has a shape including respective outer surface side profiles of vertical walls 501*a*, 501*b*, and outward extending flanges 501*d*, 501*e* of the curving component 501, the pad 503 that has a shape including the outer surface side profile of a top plate 501*c*, the punch 504 that is disposed facing the die 502 and the pad 503 and that has a shape including respective inner surface side profiles of the top plate 501*c* and the vertical walls 501*a*, 501*b* of the curving component 501, and the blank holder 505, serving as a holder, with a shape including inner surface side profiles of the outward extending flanges 501*d*, 501*e*.

As illustrated in FIG. 6A to FIG. 6D, the die 502 is disposed at an upper side of the punch 504, and a central portion in the short direction (the left-right direction on the page) of the die 502 is formed with an opening 502*a* opening toward the punch 504 side. Inner walls of the opening 502*a* of the die 502 configure forming faces including the profile of the outer surfaces of the vertical walls 501*a*, 501*b* (see FIG. 5) of the curving component 501. Moreover, end faces on the blank holder 505 side of both die 502 short direction side portions configure forming faces including the profile of the faces on the vertical wall 501*a*, 501*b* sides of the outward extending flanges 501*d*, 501*e* of the curving component 501 (see FIG. 5). A pad press device 506, described later, is fixed to the closed end (upper end) of the opening 502*a* formed in the die 502. Moreover, the die 502 is coupled to a mover device 509 such as a gas cushion, a hydraulic device, a spring, or an electric drive device. Actuating the mover device 509 enables up-down direction movement of the die 502.

The pad 503 is disposed inside the opening 502*a* formed in the die 502. The pad 503 is coupled to the pad press device 506, this being a gas cushion, a hydraulic device, a spring, an electric drive device, or the like. A face on the die 502 side of the pad 503 configures a forming face including the profile of the outer surface of the top plate 501*c* (see FIG. 5) of the curving component 501. When the pad press device 506 is actuated, the pad 503 is pressed toward the punch 504 side, and a central portion 601*a* in the short direction (the left-right direction on the page) of the metal stock sheet 601 is pressed and gripped between the pad 503 and the punch 504.

The punch 504 is formed by a protruding shape toward the pad 503 side at a location in the lower mold that faces the pad 503 in the up-down direction. Blank holder press devices 507, described later, are fixed at the sides of the punch 504. Outer faces of the punch 504 configure forming faces including the profile of the inner surfaces of the vertical walls 501*a*, 501*b* and the top plate 501*c* (see FIG. 5) of the curving component 501.

The blank holder 505 is coupled to the blank holder press devices 507, serving as holder press devices, these being gas cushions, hydraulic devices, springs, electric drive devices, or the like. Die 502 side end faces of the blank holder 505 configure forming faces including the profile of faces of the outward extending flanges 501*d*, 501*e* of the curving component 501 on the opposite side to the vertical walls 501*a*, 501*b* (see FIG. 5). When the blank holder press devices 507 are actuated, the blank holder 505 is pressed toward the die 502 side, and both short direction side portions 601*b*, 601*c* of the metal stock sheet 601 are pressed and gripped.

Next, explanation follows regarding a pressing process of the metal stock sheet 601 by the hat-shaped cross-section component manufacturing apparatus 500 described above.

First, as illustrated in FIG. 6A, the metal stock sheet 601 is disposed between the die 502 and pad 503, and the punch 504 and blank holder 505.

Next, as illustrated in FIG. 6B, the central portion 601*a* of the metal stock sheet 601, namely a portion of the metal stock sheet 601 that will form the top plate 501*c* (see FIG. 5), is pressed against the punch 504 by the pad 503, and pressed and gripped between the two. Both side portions 601*b*, 601*c* of the metal stock sheet 601, namely respective portions of the metal stock sheet 601 that will form the vertical walls 501*a*, 501*b* and the outward extending flanges 501*d*, 501*e* (see FIG. 5), are pressed against the die 502 by the blank holder 505, and are pressed and gripped between the two.

The pad press device 506 and the blank holder press devices 507 are actuated, such that the central portion 601*a* and both side portions 601*b*, 601*c* of the metal stock sheet 601 are pressed with a specific pressing force and gripped. The central portion 601*a* and both side portions 601*b*, 601*c* of the metal stock sheet 601 are formed into curved profiles to follow the curved profiles of the pressing curved faces as a result.

In this state, the mover device 509 is actuated, and the blank holder 505 and the die 502 are moved relatively in a direction away from the die 502 toward the blank holder 505

(toward the lower side), thereby forming the curving component 501. The pad press device 506 and the blank holder press devices 507 retract in the up-down direction accompanying lowering of the die 502. When the pad press device 506 and the blank holder press devices 507 retract in the up-down direction, the central portion 601*a* and both side portions 601*b*, 601*c* of the metal stock sheet 601 are pressed with a specific pressing force.

As illustrated in FIG. 6C, the metal stock sheet 601 gripped between the die 502 and the blank holder 505 flows into the opening 502*a* between the punch 504 and the die 502 accompanying the movement of the blank holder 505 and the die 502, thereby forming the vertical walls 501*a*, 501*b* (see FIG. 5).

Then, as illustrated in FIG. 6D, the blank holder 505 and the die 502 move by a specific distance, and forming is completed at the point when the height of the vertical walls 501*a*, 501*b* reaches a specific height.

Note that in the example illustrated in FIG. 6A to FIG. 6D, the curving component 501 is formed by moving the blank holder 505 and the die 502 in a stationary state of the punch 504 and the pad 503. However, the present invention is not limited thereto, and the curving component 501 may be formed in the following manner.

Figure 7:
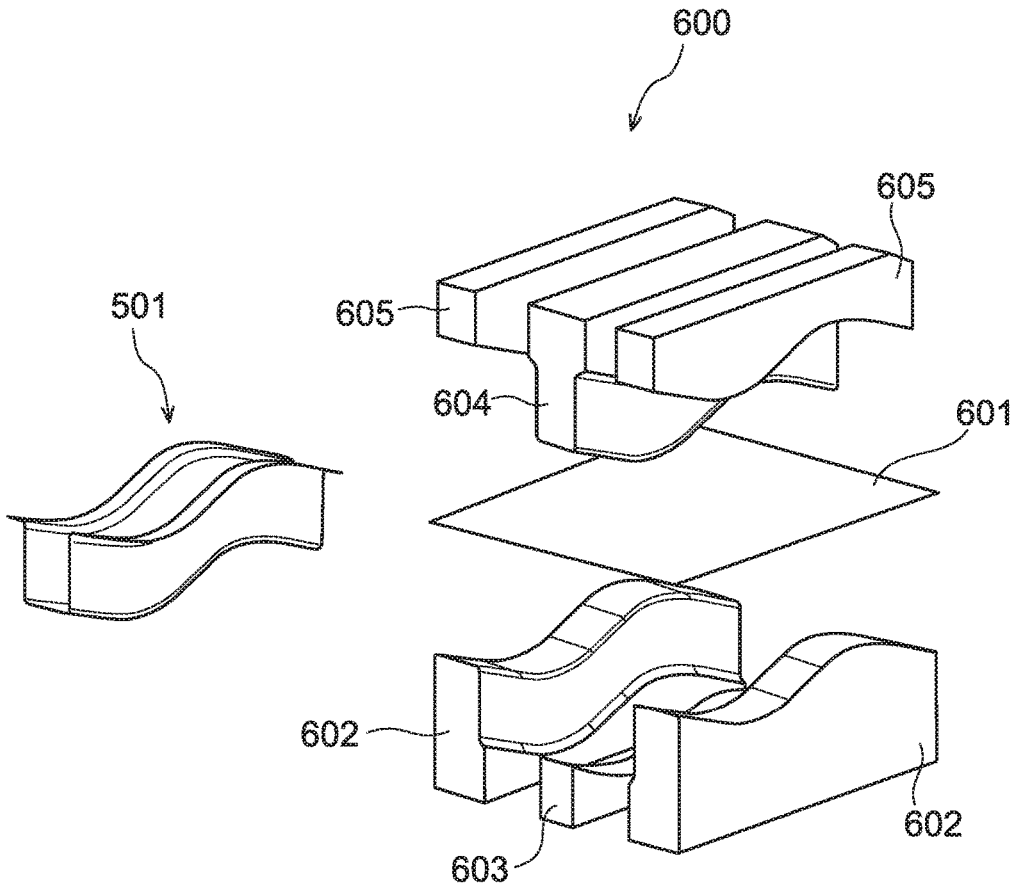
FIG. 7 is an exploded perspective view illustrating another hat-shaped cross-section component manufacturing apparatus.
Figure 8A:
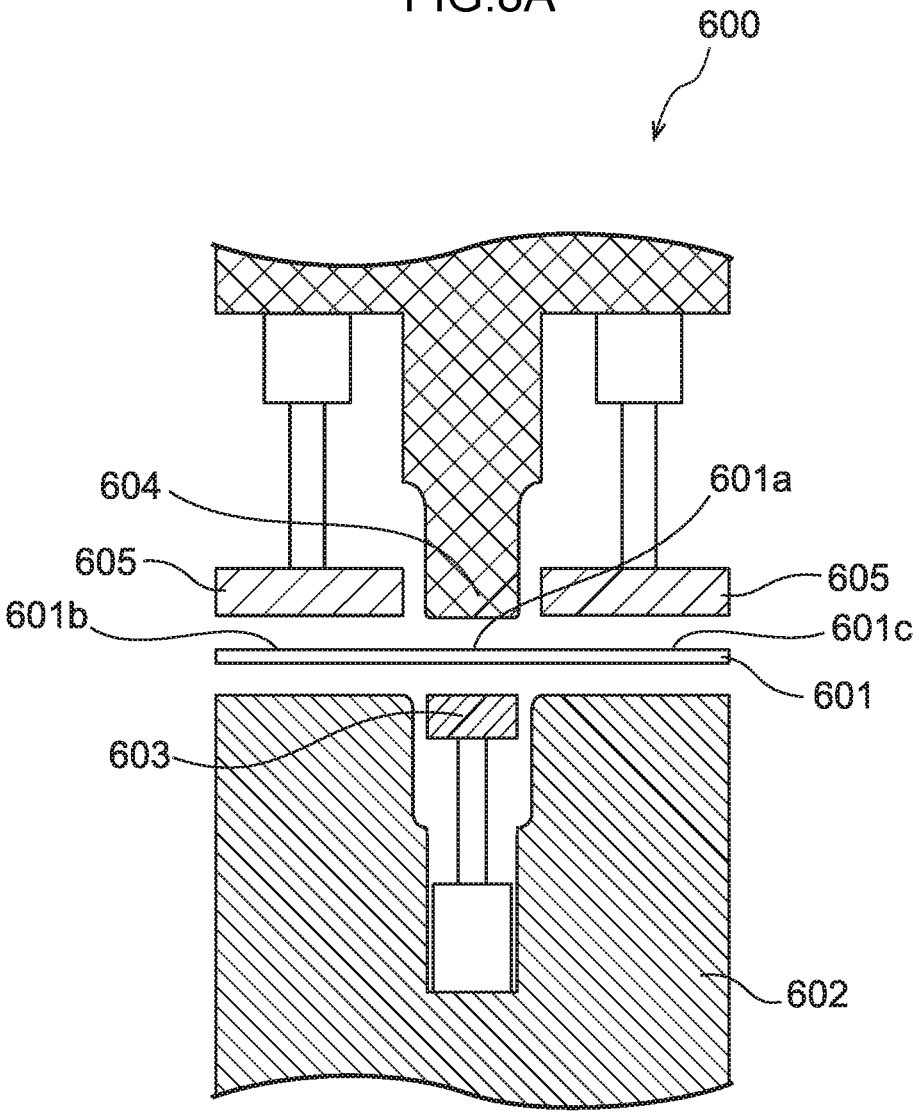
FIG. 8A is a cross-section illustrating the hat-shaped cross-section component manufacturing apparatus illustrated in FIG. 7, at a stage at the start of processing.
Figure 8B:
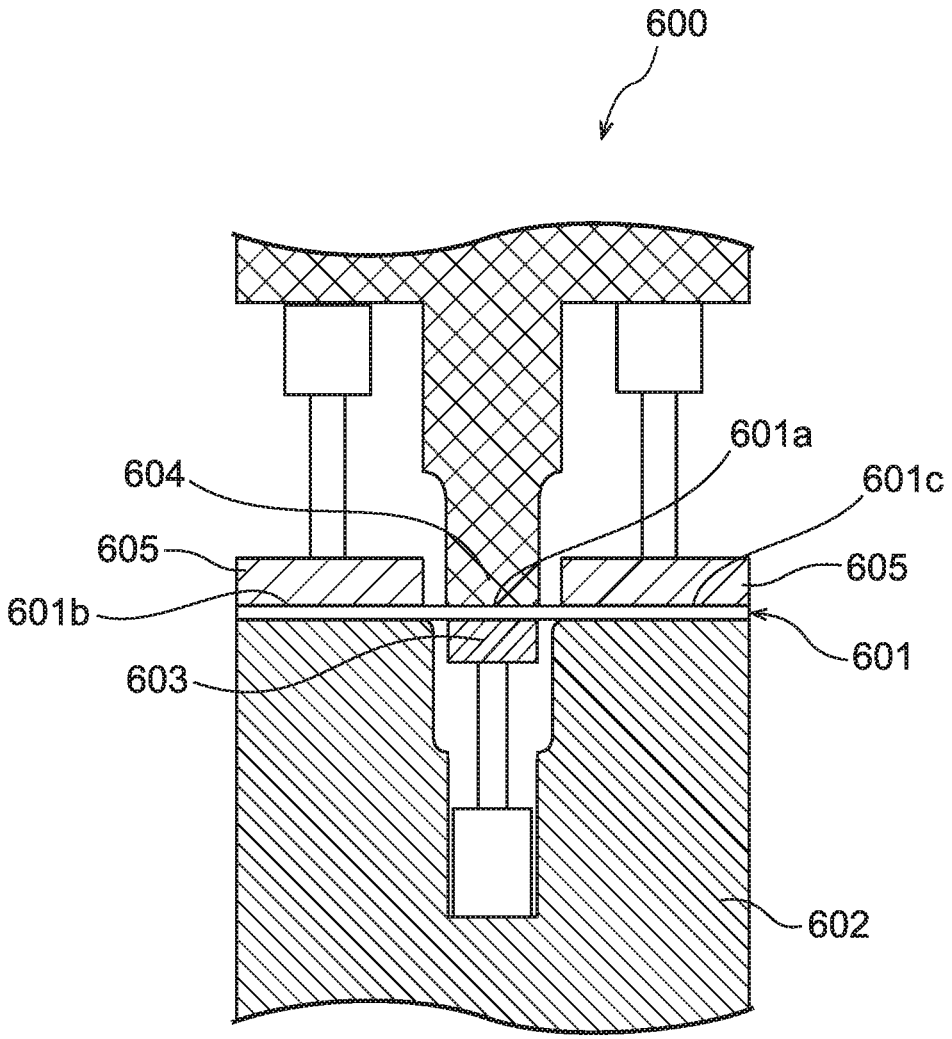
FIG. 8B is a cross-section illustrating a stage at which the metal stock sheet is gripped and restrained between a die and pad, and a holder and punch of the hat-shaped cross-section component manufacturing apparatus illustrated in FIG. 7.
Figure 8C:
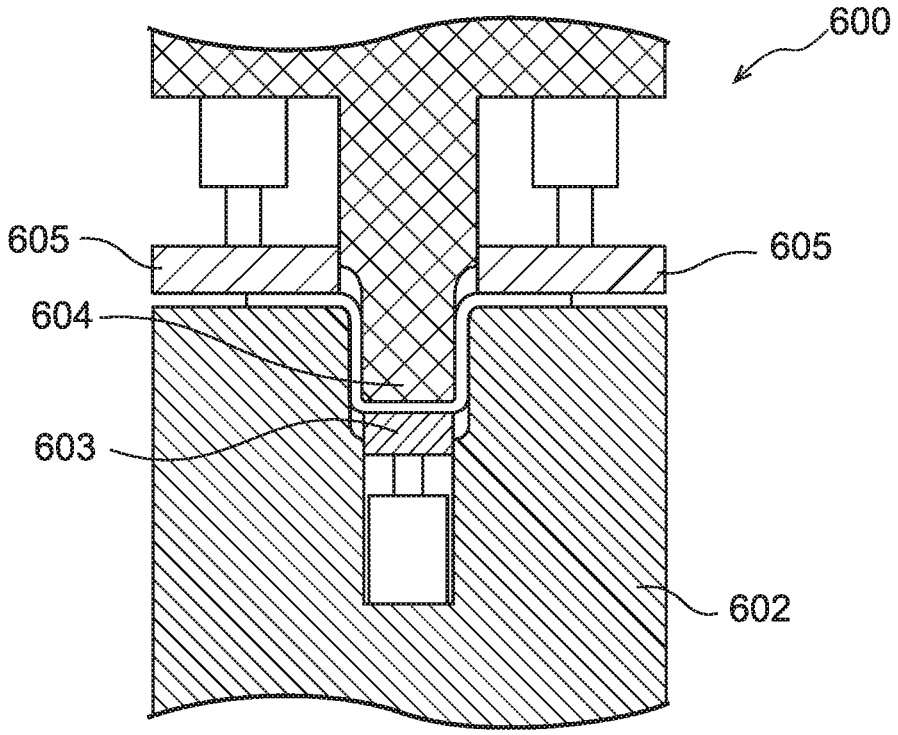
FIG. 8C is a cross-section illustrating a stage at which the punch has been pushed in from the stage illustrated in FIG. 8B.
Figure 8D:
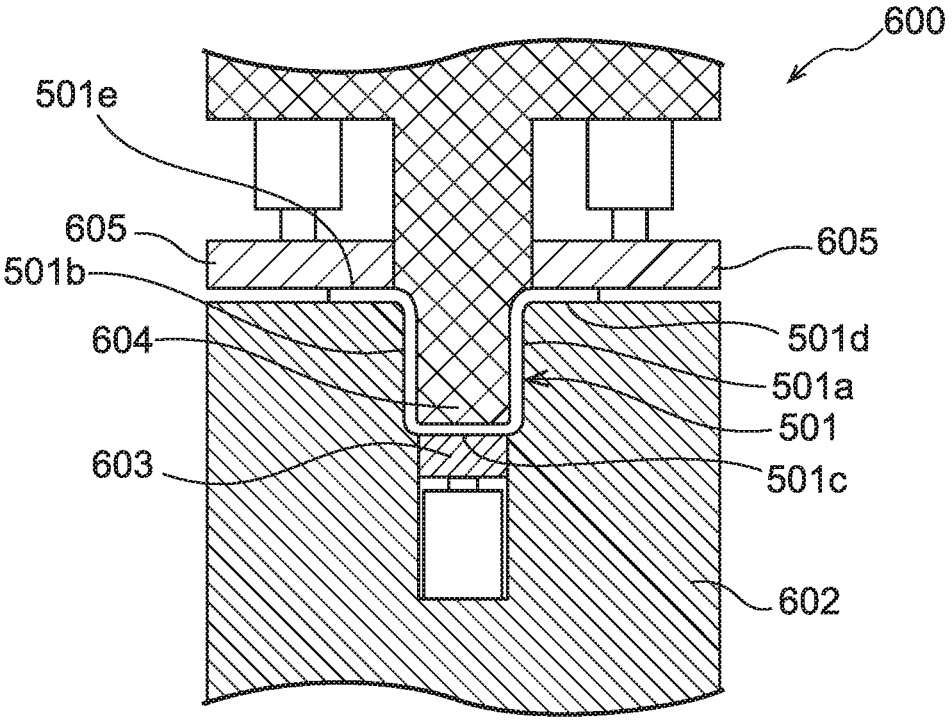
FIG. 8D is a cross-section illustrating a state in which the punch has been pushed in further from the stage illustrated in FIG. 8C, such that the punch has been fully pushed in with respect to the die.

FIG. 7 illustrates a hat-shaped cross-section component manufacturing apparatus 600 according to another exemplary embodiment for manufacturing the curving component 501. FIG. 8A is a cross-section illustrating the manufacturing apparatus illustrated in FIG. 7 at a stage at the start of processing. FIG. 8B is a cross-section illustrating a stage at which the metal stock sheet 601 is gripped and restrained between a die 602 and pad 603, and a blank holder 605 and punch 604 of the manufacturing apparatus illustrated in FIG. 7. FIG. 8C is a cross-section illustrating a stage at which the punch 604 has been pushed in from the stage illustrated in FIG. 8B. FIG. 8D is a cross-section illustrating a state in which the punch 604 has been pushed in further from the stage illustrated in FIG. 8C, such that the punch 604 has been fully pushed in with respect to the die 602.

In contrast to the hat-shaped cross-section component manufacturing apparatus 500 illustrated in FIG. 5 and FIG. 6A to FIG. 6D, in the hat-shaped cross-section component manufacturing apparatus 600 the blank holder 605 and the punch 604 are provided at an upper side of the die 602 and the pad 603. In the hat-shaped cross-section component manufacturing apparatus 600, the curving component 501 is formed by moving (lowering) the pad 603 and the punch 604 in a state in which the die 602 is fixed, and the blank holder 605 presses the metal stock sheet 601 against the die 602 without moving. Note that in both the hat-shaped cross-section component manufacturing apparatus 600 and the hat-shaped cross-section component manufacturing apparatus 500, the relative movement within the mold is the same, and the metal stock sheet 601 can be formed into the curving component 501 by using whichever of the hat-shaped cross-section component manufacturing apparatuses 500, 600.

Next, explanation follows regarding a removal process of the curving component 501 from the hat-shaped cross-section component manufacturing apparatus 500 (mold) after pressing the metal stock sheet 601, namely after forming the curving component 501.

Figure 9A:
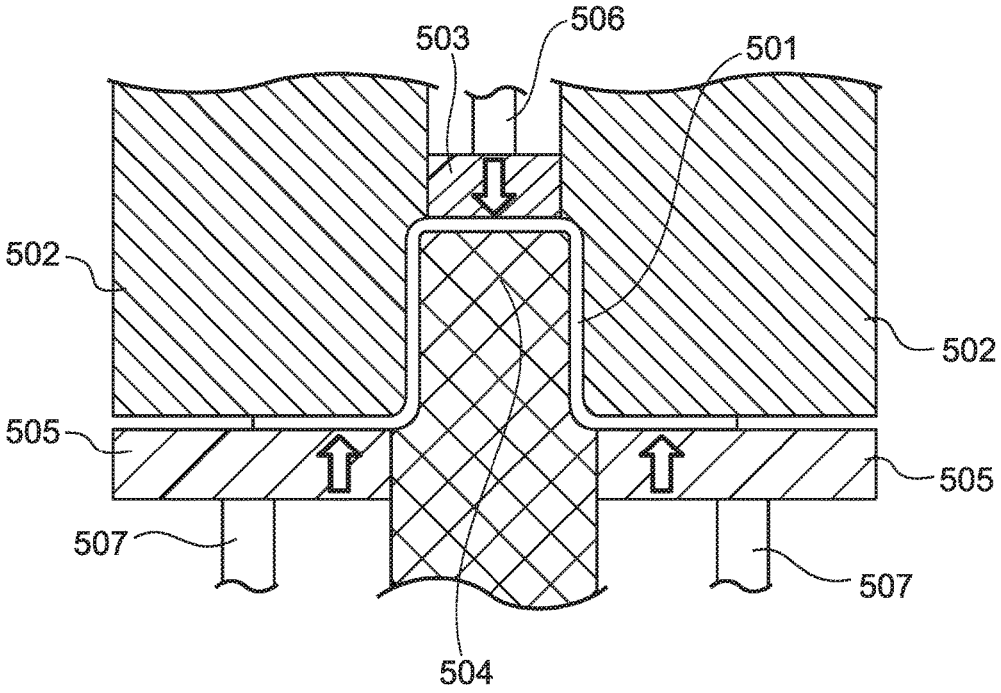
FIG. 9A is a cross-section illustrating a mold to explain a defect that occurs when removing a curving component from the mold after a punch has been fully pushed into a die and a metal stock sheet has been formed into the curving component.
Figure 9B:
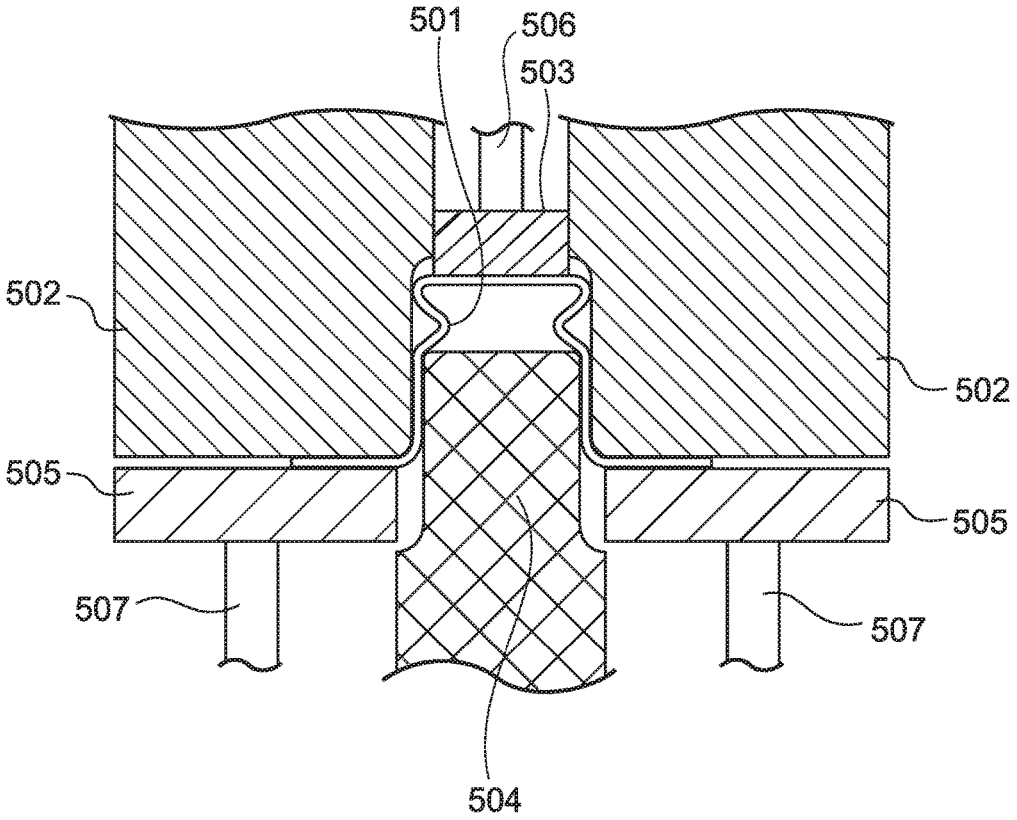
FIG. 9B is a cross-section illustrating the mold at a stage in which the punch is being retracted from the die from the state illustrated in FIG. 9A.
Figure 9C:
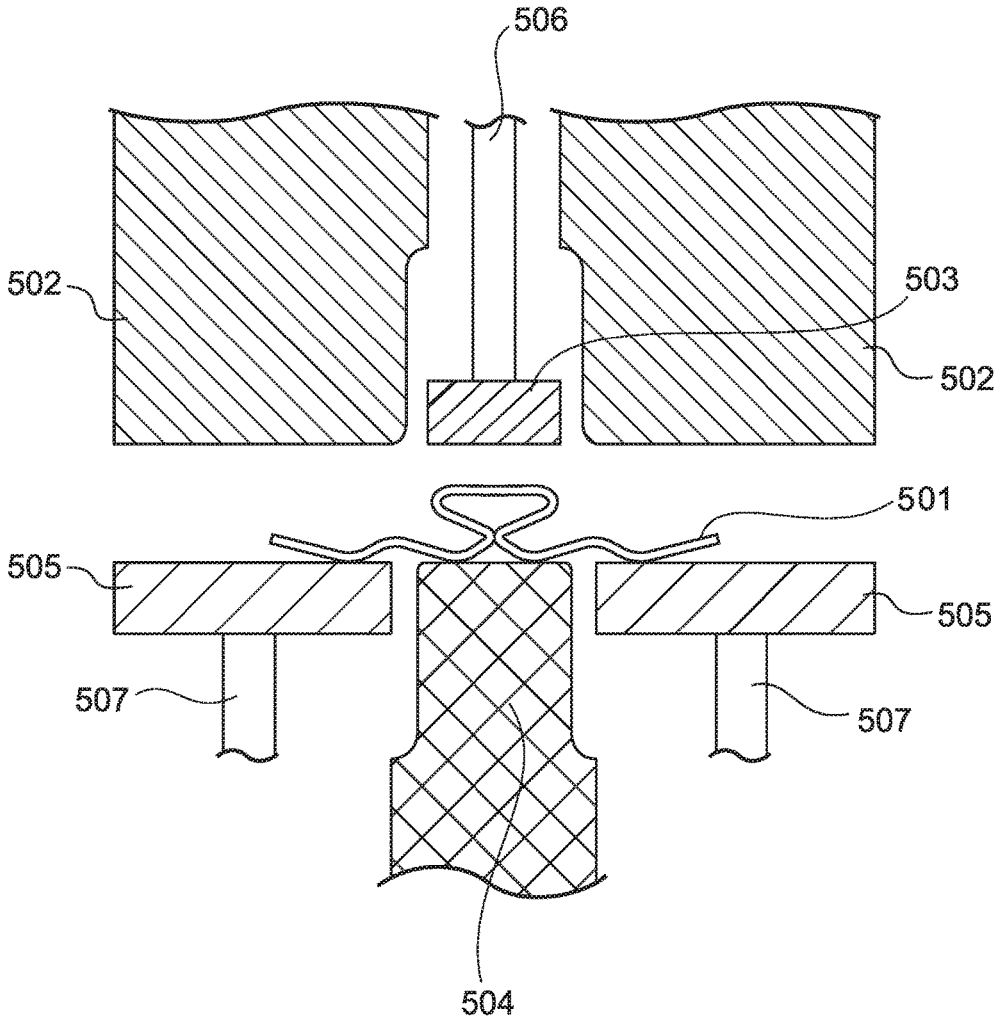
FIG. 9C is a cross-section illustrating the mold at a stage in which the punch has been fully retracted from the die from the state illustrated in FIG. 9B.

As illustrated in FIG. 9A to FIG. 9C, when the curving component 501 is demolded from the hat-shaped cross-section component manufacturing apparatus 500 (mold), it is necessary to move the die 502 upward from the state in FIG. 6D and away from the punch, 504 to create a gap within the mold. When this is performed, as illustrated in FIG. 9B and FIG. 9C, while the pad 503 and the blank holder 505 are being pressed by the respective pad press device 506 and the blank holder press devices 507, the curving component 501 bears pressing force directed in mutually opposing directions from the pad 503 and the blank holder 505 during demolding, deforming and crushing the curving component 501 by the pressing forces directed in opposite directions, as illustrated in FIG. 9C.

Figure 10A:
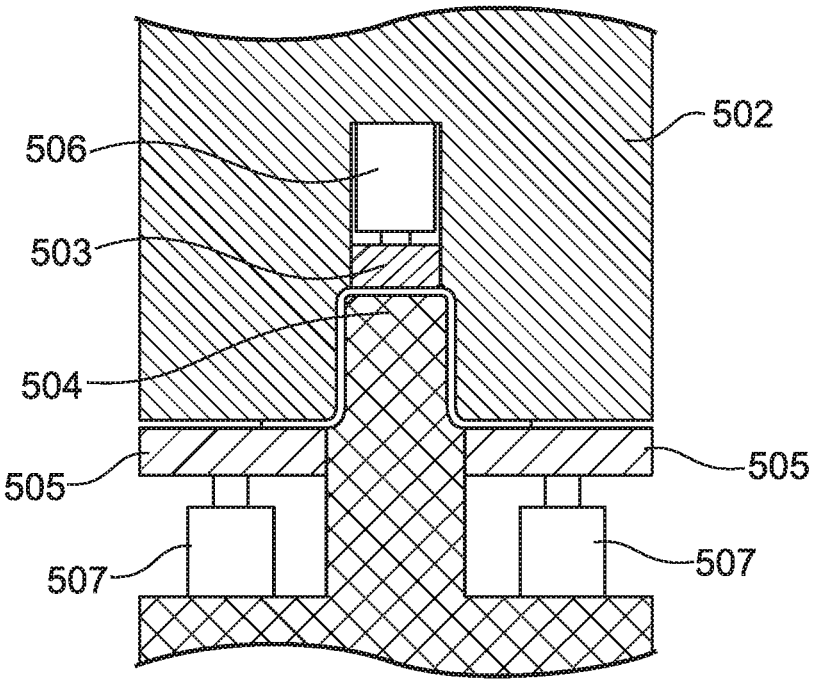
FIG. 10A is a cross-section illustrating a mold, in a state in which a punch has been fully pushed into a die.
Figure 10B:
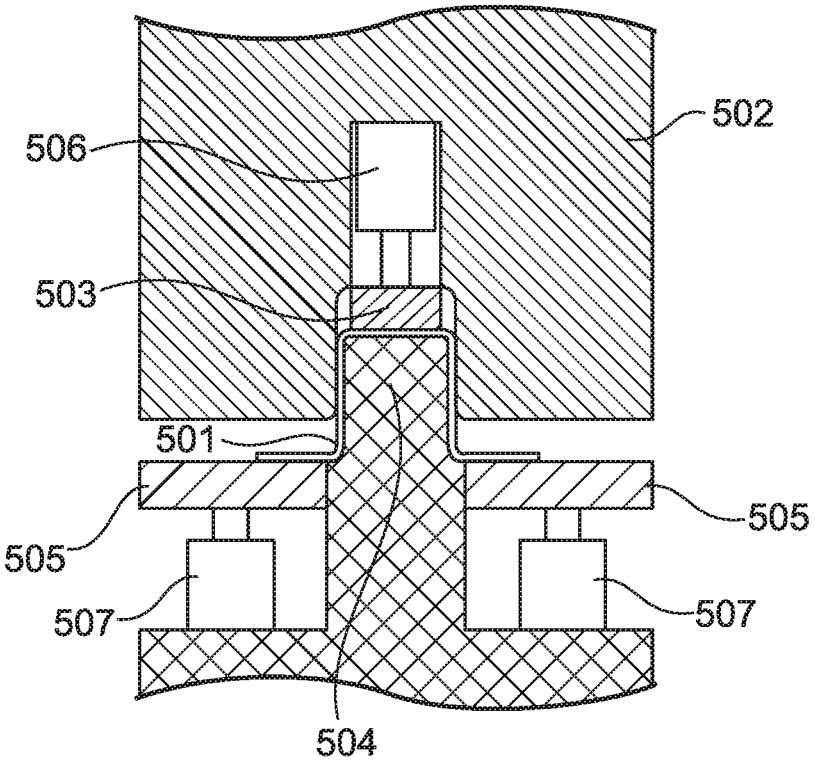
FIG. 10B is a cross-section illustrating the mold at a stage in which the punch is being retracted from the die from the state illustrated in FIG. 10A.
Figure 10C:
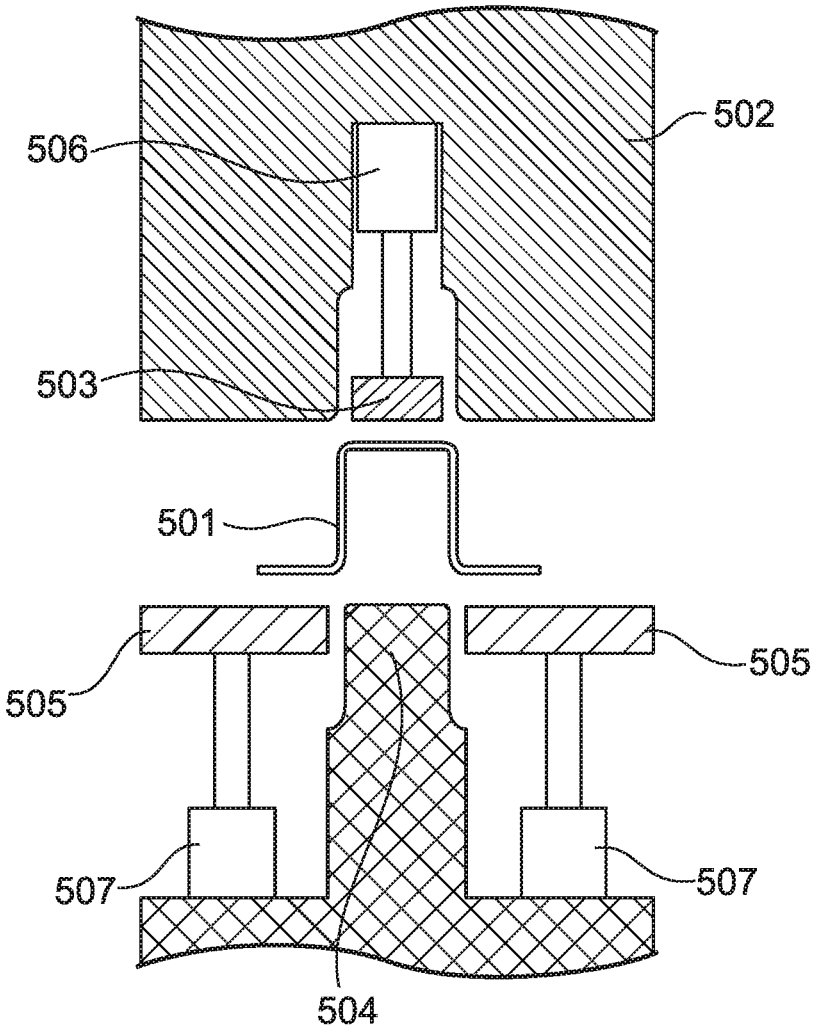
FIG. 10C is a cross-section illustrating the mold at a stage in which the punch has been fully retracted from the die from the state illustrated in FIG. 10B.

Accordingly, as illustrated in FIG. 10A to FIG. 10C, after the metal stock sheet 601 has been formed into the curving component 501, configuration is made such that the die 502 and the pad press device 506 are separated from the blank holder 505 in a state in which the blank holder 505 does not move relative to the punch 504, and the blank holder 505 does not press the formed curving component against the die 502. Accordingly, although the pad press device 503 presses the curving component until the pad press device 506 has extended to the end of its stroke, after the pad press device 506 has moved a specific distance or greater and the pad press device 506 has fully extended to the end of its stroke, the pad 503 is separated from the punch 504. The curving component 501 therefore does not bear pressing from the pad 503 and the blank holder 505 at the same time, and the die 502 and the pad 503 can be separated from the blank holder 505 and the punch 504, thereby enabling the curving component 501 to be removed from the mold without being deformed.

Figure 11A:
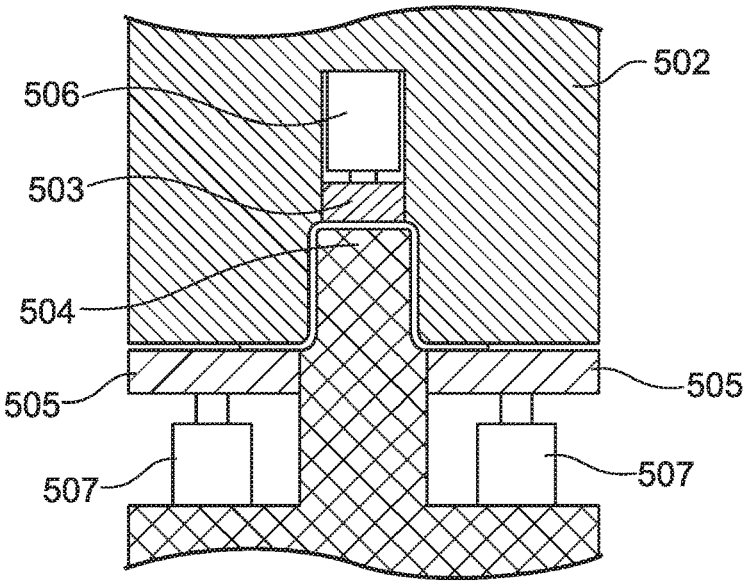
FIG. 11A is a cross-section illustrating a mold, in a state in which a punch has been fully pushed into a die.
Figure 11B:
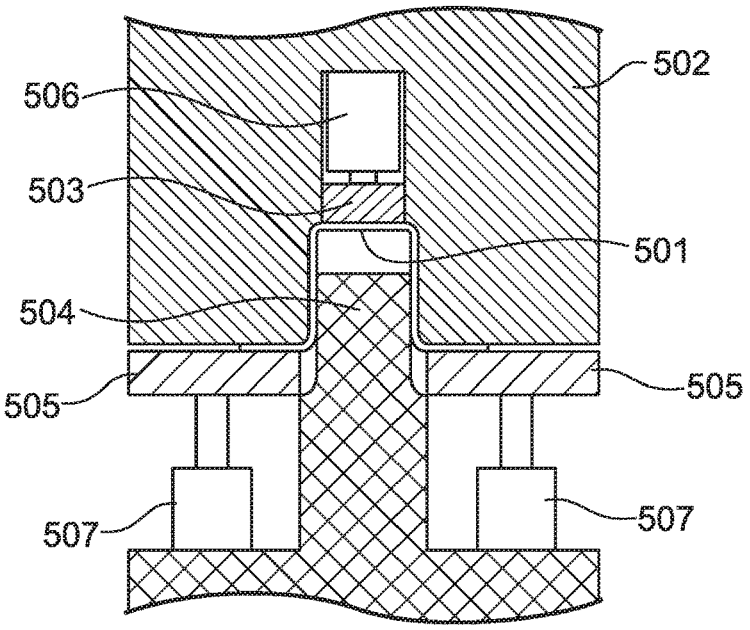
FIG. 11B is a cross-section illustrating the mold at a stage in which the punch is being retracted from the die from the state illustrated in FIG. 11A.
Figure 11C:
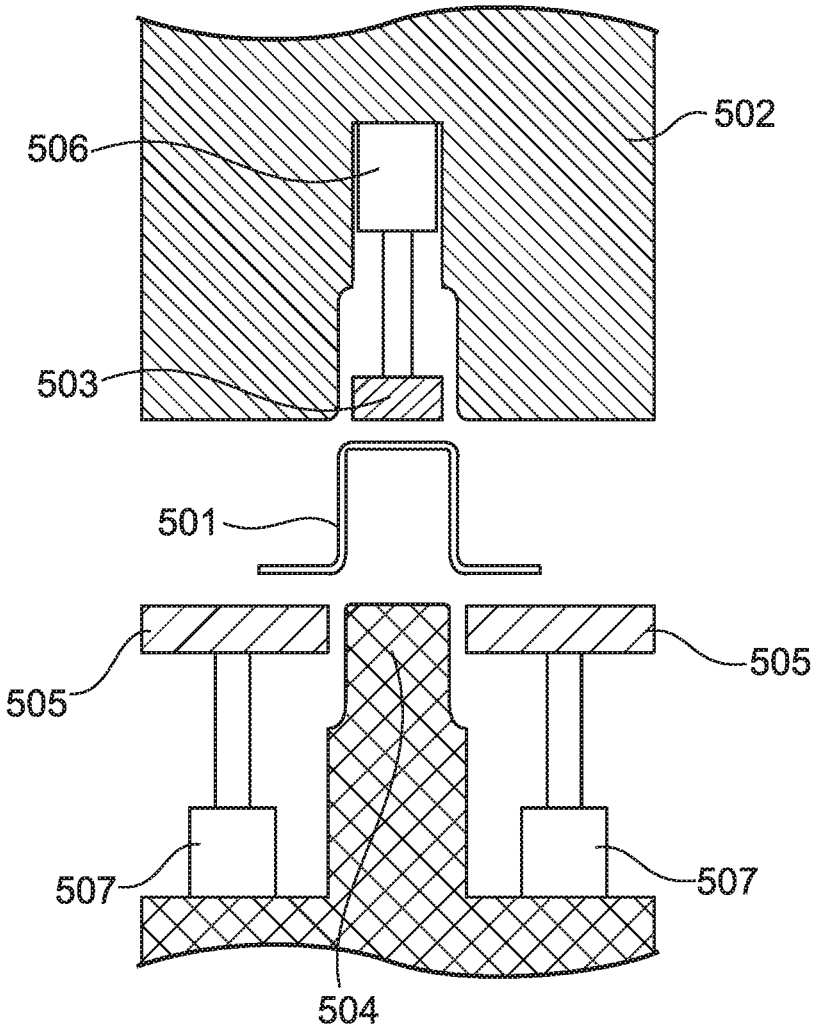
FIG. 11C is a cross-section illustrating the mold at a stage in which the punch has been fully retracted from the die from the state illustrated in FIG. 11B.

As another exemplary embodiment, as illustrated in FIG. 11A to FIG. 11C, after forming the metal stock sheet into the curving component 501, the pad 503 is not moved relative to the die 502, and the pad 503 does not press the formed curving component 501 against the punch 504. In this state, when the pad 503 and the die 502 are separated from the blank holder 505 and the punch 504, the blank holder 505 press the curving component until the blank holder press devices 507 extend to the end of their stroke. The blank holder 505 is then separated from the die 502 after the die 502 has moved a specific distance or greater and the blank holder press devices 507 have fully extended to the end of their stroke. This thereby enables the die 502 and pad 503, and the blank holder 505 and punch 504, to be separated without the curving component 501 bearing pressure from the pad 503 and the blank holder 505 at the same time, thereby enabling the curving component 501 to be removed from the mold.

Yet another exemplary embodiment is one in which, although not illustrated in the drawings, after forming the metal stock sheet into the curving component 501, the pad 503 does not move relative to the blank holder 505, and the pad 503 does not press the formed curving component against the punch 504. In this state, when the pad 503, die 502, and blank holder 505 are separated from the punch 504, the blank holder 505 presses the curving component 501 until the blank holder press devices 507 have extended to the end of their strokes. After the die 502 moves a specific distance or greater and the blank holder press devices 507 have fully extended to the end of their stroke, the blank holder 505 is then separated from the die 502. This thereby enables the die 502 and pad 503 to be separated, from the blank holder 505 and punch 504, without the curving component 501 bearing pressure from the pad 503 and the blank holder 505 at the same time, thereby enabling the curving component 501 to be removed from the mold.

Accordingly, in order to prevent damage to the curving component 501 during demolding, the hat-shaped cross-section component manufacturing apparatus 500 may be provided with a pressure limiting device capable of preventing the curving component 501 from bearing pressure from the pad 503 and the blank holder 505 at the same time.

Explanation follows regarding a specific configuration of a pressure limiting device provided to the hat-shaped cross-section component manufacturing apparatus 500.

Pressure Limiting Device 510 Configuration

As illustrated in FIG. 12A, the pressure limiting device 510 includes floating blocks 514 that are formed in rectangular block shapes, and serve as a pressure limiting section. The pressure limiting device 510 further includes a pair of holding arms 511, serving as a retention section, that engage with the floating blocks 514 when forming of the curving component 501 is completed, thereby integrating the floating blocks 514 together with the blank holder 505, namely, enabling the floating blocks 514 to move as a unit with the blank holder 505. The pressure limiting device 510 further includes a retention release section 515 that releases retention of the floating blocks 514 by the holding arms 511.

As illustrated in FIG. 12B, two of the floating blocks 514 are provided on a base plate 508. Note that in the present exemplary embodiment, explanation is given regarding a case in which two of the floating blocks 514 are employed; however, a single floating block may be employed depending on the shape and dimensions of the curving component 501 to be formed, or three or more floating blocks may be employed in cases in which there is a large pad load.

The two floating blocks 514 are formed using a block shaped steel material having a rigidity and strength so as not to buckle or plastically deform even when bearing the pressing force of the pad 503. The two floating blocks 514 are respectively disposed on the base plate 508 on both length direction sides of the punch 504, and are capable of ascending and descending. As illustrated in FIG. 12A, a location on an upper side of each floating block 514 configures a block upper portion 514*a* with a width dimension that is a substantially uniform dimension as viewed from the side, and a location on a lower side of each floating block 514 configures a block lower portion 514*b* that, as viewed from the side, has a width dimension that is a dimension of the width dimension of the block upper portion 514*a* or greater, and that is formed such that its width dimension gradually narrows on progression toward the upper side. The retention release section 515, described later, is provided to the block upper portion 514*a*. As illustrated in FIG. 12C, FIG. 12D, and FIG. 12E, both length direction end portions of the blank holder 505 are formed with block upper portion insertion holes 505*a* through which the block upper portions 514*a* pass. As illustrated in FIG. 12A, a lower end portion of the block lower portion 514*b* is formed with recess shaped engaged-with portions 514*c* with which engagement portions 511*c* of the holding arms 511, described later, engage.

As illustrated in FIG. 12A and FIG. 12D, the pair of holding arms 511 are disposed inside holding arm housing holes 505*b* formed integrally to the block upper portion insertion holes 505*a*. Moreover, the pair of holding arms 511 each include a swinging block 511*a* formed in a block shape with its length direction in the up-down direction as viewed from the side, and a rod shaped extension portion 511*b* extending from the swinging block 511*a* toward the upper side. A lower end portion of each swinging block 511*a* is configured by a hook shaped engagement portion 511*c* that engages with the engaged-with portion 514*c* formed to the block lower portion 514*b* of the floating block 514. An upper portion of the swinging block 511*a* is supported by the blank holder 505 through a pin 516, so as to be capable of swinging.

At the forming bottom dead center, namely, on completion of forming the curving component 501 (see FIG. 6D), the swinging blocks 511*a* swing toward one side (swing in the direction of the arrows C1) as illustrated in FIG. 12A, such that the engagement portions 511*c* of the swinging blocks 511*a* engage with the engaged-with portions 514*c* of the floating block 514. As illustrated in FIG. 12D, this thereby enables the floating block 514 to move together as a unit with the blank holder 505. Moreover, as illustrated in FIG. 12A, in the present exemplary embodiment, a pair of springs 512 to which rollers 513 are attached are fixed to the base plate 508 (see FIG. 12B). At the forming bottom dead center, the pair of springs 152 press the swinging blocks 511*a* of the holding arms 511 through the rollers 513, such that the swinging blocks 511*a* swing toward the one side (swing in the arrow C1 direction), and the engagement portions 511*c* of the swinging blocks 511*a* engage with the engaged-with portions 514*c* of the floating block 514. Part of the pad 503 is in contact with an upper end portion of the floating block 514 as the floating block 514 ascends together with the blank holder 505. Accordingly, movement of the pad 503 and the punch 504 in approaching directions is prevented by the pressure limiting device 510, and, during demolding, either the formed curving component 501 (see FIG. 6D) is not pressed between the pad 503 and the blank holder 505, or only a small amount of pressure acts thereon.

From the state illustrated in FIG. 12A, the swinging blocks 511*a* then swing toward another side (swing in the direction of the arrows C2), thereby releasing the engagement between the engagement portions 511*c* of the swinging blocks 511*a* and the engaged-with portions 514*c* of the floating block 514. In the present exemplary embodiment, part of the retention release section 515, described later, presses the extension portions 511*b* of the holding arms 511, such that the swinging blocks 511*a* swing toward the another side (swing in the direction of the arrows C2), thereby releasing the engagement between the engagement portions 511*c* of the swinging blocks 511*a* and the engaged-with portions 514*c* of the floating block 514.

The retention release section 515 includes a tilt plate 518. The tilt plate 518 is disposed inside an opening 514*d* that opens onto a side of the block upper portion 514*a*, and is supported at intermediate portions by pins 517, so as to be capable of tilting. At an upper side of the tilt plate 518, a pad load transmission rod 519 is provided disposed inside an opening 514*e* that places an upper end of the block upper portion 514*a* in communication with the opening 514*d*. A coil spring 520 is provided at a lower side of the tilt plate 518.

One end portion 518*a* of the tilt plate 518 projects out from the floating block 514 toward the side, and the one end portion 518*a* of the tilt plate 518 is disposed at an upper side of the extension portions 511*b* of the holding arms 511 when the floating blocks 514 and the blank holder 505 are in an integrated state, as illustrated in FIG. 12A and FIG. 12D.

The pad load transmission rod 519 is disposed at an upper side of another end portion 518*b* of the tilt plate 518. The pad load transmission rod 519 is pressed toward the lower side by the pad 503, such that the pad load transmission rod 519 presses the other end portion 518*b* of the tilt plate 518. Accordingly, in a state in which the pad 503 contacts an upper end portion of the block upper portion 514*a*, the one end portion 518*a* of the tilt plate 518 moves away from the extension portions 511*b* of the holding arms 511. The holding arms 511 are then able to swing in the arrow C1 directions, enabling, as illustrated in FIG. 12A, the engagement portions 511*c* of the holding arms 511 to engage with the engaged-with portions 514*c* of the floating block 514.

The coil spring 520 is disposed at a lower side of the other end portion 518*b* of the tilt plate 518, and the coil spring 520 biases the other end portion 518*b* of the tilt plate 518 toward the upper side. Accordingly, in a state in which the pad 503 has moved away from the upper end portion of the block upper portion 514*a*, the one end portion 518*a* of the tilt plate 518 tilts toward the side of the extension portions 511*b* of the holding arms 511, and the one end portion 518*a* of the tilt plate 518 presses the extension portions 511*b* of the holding arms 511. Accordingly, the swinging blocks 511*a* swing in the arrow C2 directions against the pressing force of the rollers 513 from the springs 512, releasing the engagement between the engagement portions 511*c* of the swinging blocks 511*a* and the engaged-with portions 514*c* of the floating block 514. Namely, retention of the floating block 514 by the holding arms 511 is released.

Next, explanation follows regarding operation of the pressure limiting device 510.

FIG. 13A and FIG. 14A illustrate a state of the curving component 501 prior to the start of forming. At the timing illustrated in FIG. 13B and FIG. 14B, the metal stock sheet 601 is gripped by the pad 503 and punch 504, and the die 502 and blank holder 505. Note that in the present exemplary embodiment, adjustment blocks 521 are interposed between the pad 503 and the floating blocks 514. Clearance is thereby adjusted according to variations in sheet thickness of the metal stock sheet 601 and the like. In the present exemplary embodiment, respective adjustment blocks 521 are fixed to both length direction end portions of the pad 503. In the following explanation, contact between the adjustment blocks 521 and the floating blocks 514 includes cases in which the pad 503 contacts the floating blocks 514 directly. Moreover, at the timing illustrated in FIG. 13B and FIG. 14B, both length direction end portions of the pad 503 are in contact with the upper end portions of the floating blocks 514 through the adjustment blocks 521.

At the timing illustrated in FIG. 13C and FIG. 14C, the metal stock sheet 601 gripped between the die 502 and the blank holder 505 flows into the opening 502*a* between the punch 504 and the die 502, and the vertical walls 501*a*, 501*b* of the curving component 501 is formed, as the blank holder 505 and the die 502 move toward the lower side. Then, at the timing illustrated in FIG. 13D and FIG. 14D, the blank holder 505 and the die 502 move to the forming bottom dead center, and forming of the curving component 501 is completed. In this state, both length direction end portions of the pad 503 are in contact with the upper end portions of the floating blocks 514 through the adjustment blocks 521.

When the blank holder 505 has moved to the forming bottom dead center, the adjustment blocks 521 press down the tops of the pad load transmission rods 519 in the arrow Z direction, as illustrated in FIG. 12A, such that the one end portion 518*a* of each tilt plate 518 separates from the extension portions 511*b* of the holding arms 511, and the engagement portions 511*c* of the holding arms 511 engage with the engaged-with portions 514*c* of the floating blocks 514 under the biasing force of the springs 512. The blank holder 505 is thereby coupled together with the floating blocks 514, and in the subsequent demolding process, the blank holder 505 and the floating blocks 514 ascend together as a unit.

After reaching the forming bottom dead center, as illustrated in FIG. 13E and FIG. 13F, and in FIG. 14E and FIG. 14F, when the blank holder 505 ascends together with the floating blocks 514, the top plate 501*c* of the curving component 501 that was hitherto in contact with an upper face of the punch 504 separates from the upper face of the punch 504. When the blank holder 505 is ascending together with the floating block 514, the floating blocks 514 are coupled to the blank holder 505 through the holding arms 511, and the pad 503 and the blank holder 505 are prevented from moving relative to each other in approaching directions along the up-down direction. During the demolding process, even if the formed curving component 501 bears force along the approaching directions of the pad press device 506 and the blank holder press devices 507 (see FIG. 11B) due to the force thereof, the formed curving component 501 is not pressed between the pad 503 and the blank holder 505 to such an extent that it is deformed.

As illustrated in FIG. 13G and FIG. 14G, the curving component 501 can be removed when the die 502 ascends to its top dead center. When the die 502 reaches the top dead center, and the pad 503 separates from the floating blocks 514, namely when the adjustment blocks 521 attached to the pad 503 separate from the floating blocks 514, as illustrated in FIG. 12D, the one end portion 518*a* of each tilt plate 518 presses the extension portions 511*b* of the holding arms 511 under the biasing force of the coil spring 520. Accordingly, the swinging blocks 511*a* swing in the arrow C2 directions, and the engagement between the engagement portions 511*c* of the swinging blocks 511*a* and the engaged-with portions 514*c* of the floating block 514 is released. Then, as illustrated in FIG. 13G, the floating blocks 514 drop through the block upper portion insertion holes 505*a* and the holding arm housing holes 505*b* (see FIG. 12C), and return to their home positions on the base plate 508 (see FIG. 12B).

As described above, in the present exemplary embodiment, employing the hat-shaped cross-section component manufacturing apparatus 500 provided with the pressure limiting device 510 enables the formed curving component 501 to be demolded without sustaining damage. The hat-shaped cross-section component manufacturing apparatus 500 of the present exemplary embodiment moreover enables the curving component 501 to be demolded without any increase in cycle time compared to conventional manufacturing apparatus that is not provided with the pressure limiting device 510 described above. This thereby enables low cost mass production of the curving component 501.

In the present exemplary embodiment, explanation has been given regarding an example in which the floating blocks 514 and the blank holder 505 are configured capable of moving together as a unit by employing the holding arms 511. However, the present invention is not limited thereto. Namely, other mechanisms may similarly be applied as long as they are mechanisms capable of retaining the floating blocks 514 at the forming bottom dead center, and of separating the floating blocks 514 after the pad has separated from the two floating blocks 514. Examples of such configurations include:

(1) Latch types (types in which latch arms are provided to the floating blocks 514);

(2) Push pin types (methods in which sprung pins enter fixing holes from the floating blocks 514 or the blank holder 505 and form a unit therewith);

(3) Gear types (gears installed in the floating blocks 514 are retained by pressing by the pad 503, and lock with gears installed to the blank holder 505); and (4) Cam types (installed with a cam that moves horizontally accompanying downward movement of the blank holder 505, such that a leading end of the cam locks the floating block 514).

In the present exemplary embodiment, explanation has been given regarding an example in which the hook shaped engagement portions 511*c* formed to the swinging blocks 511*a* of the holding arms 511 engage with the engaged-with portions 514*c* formed to the block lower portion 514*b* of each floating block 514; however, the present invention is not limited thereto. For example, as illustrated in FIG. 15A and FIG. 15B, engagement recesses 511*d*, serving as engagement portions formed to the swinging blocks 511*a* of the holding arms 511, may engage with engagement protrusions 514*f*, serving as engaged-with portions, formed to the block lower portion 514*b* of each floating block 514.

In the present exemplary embodiment, explanation has been given regarding an example in which the retention release section 515 is provided to the block upper portion 514*a* of each floating block 514. However, the present invention is not limited thereto. For example, as illustrated in FIG. 16A, a retention release section 522 having the same function as the retention release section 515 described above may be provided to frame portions 508*a* (see also FIG. 12B) so as to extend up from both length direction end portions of the base plate 508, serving as a base section. Each retention release section 522 is configured including a tilting portion 524 that is tiltably supported by the frame portion 508*a* of the base plate 508 through a bracket 523, and a coil spring 525 that biases a leading end side 524*a* of the tilting portion 524 toward the lower side. In the retention release section 522, when the blank holder 505 and the die 502 have risen a specific distance from the forming bottom dead center illustrated in FIG. 16B, the extension portions 511*b* of the holding arms 511 contact the leading end side 524*a* of the tilting portion 524, and the extension portions 511*b* of the holding arms 511 are pressed toward the lower side by the leading end side 524*a* of the tilting portion 524. Accordingly, as illustrated in FIG. 16C and FIG. 16D, the engagement between the engagement portions 511*c* of the swinging blocks 511*a* and the engaged-with portions 514*c* of the floating block 514 is released.

In the present exemplary embodiment, explanation has been given regarding an example in which the formed curving component 501 is suppressed from being pressed between the pad 503 and the blank holder 505 by part of the pad 503 contacting the upper end portion of the floating blocks 514 through the adjustment blocks 521; however, the present invention is not limited thereto. For example, the formed curving component 501 may be suppressed from being pressed between the pad 503 and the blank holder 505 by a member that moves together with the pad 503 contacting the upper end portion of the floating block 514.

Operation and Advantageous Effects of Present Exemplary Embodiment, Suitable Values etc. for Various Parameters Next, explanation follows regarding operation and advantageous effects of the present exemplary embodiment, and suitable values for various parameters, and the like.

As illustrated in FIG. 12A to FIG. 14G, in the present exemplary embodiment, the hat-shaped cross-section component manufacturing apparatus 500 is provided with the pressure limiting device 510 described above. During demolding, the curving component 501 can be removed from the mold (the blank holder 505, the die 502, the punch 504, and the pad 503) in a state in which the formed curving component 501 is prevented by the pressure limiting device 510 from being pressed by the pad 503 and the blank holder 505 at the same time.

In the present exemplary embodiment, during formation of the vertical walls 501*a*, 501*b* of the curving component 501 by the hat-shaped cross-section component manufacturing apparatus 500 illustrated in FIG. 5 to FIG. 6D, the portion of the metal stock sheet 601 that will form the top plate 501*c* is pressed and gripped by the pad 503 and the punch 504. Provided that the pressing force is sufficient, the portion of the metal stock sheet 601 that will form the top plate 501*c* cannot be deformed in its thickness direction during the forming process, enabling the occurrence of creases at this portion to be suppressed. Moreover, the portions of the metal stock sheet 601 that will form the outward extending flanges 501*d*, 501*e* are also pressed and gripped by the blank holder 505 and the die 502, such that provided that the pressing force is sufficient, the portions of the metal stock sheet 601 that will form the outward extending flanges 501*d*, 501*e* cannot be deformed in the thickness direction, enabling the occurrence of creases at these portions to be suppressed.

However, if the above pressing forces are insufficient, deformation of the metal stock sheet 601 in the thickness direction cannot be prevented, and creases will occur at the portion of the metal stock sheet 601 that will form the top plate 501*c* and at the portions of the metal stock sheet 601 that will form the outward extending flanges 501*d*, 501*e*. The sheet thickness employed in structural members configuring automotive vehicle body framework (such as front side members) is generally from 0.8 mm to 3.2 mm. When a steel sheet with tensile strength of from 200 MPa to 1600 MPa is formed by using the hat-shaped cross-section component manufacturing apparatus 500 illustrated in FIG. 5 to FIG. 6D, the above pressing forces are preferably 0.1 MPa or greater.

FIG. 17A illustrates stress arising in the vertical walls 501*a*, 501*b* of the curving component 501. FIG. 17B and FIG. 17C illustrate shear creasing arising in the vertical walls 501*a*, 501*b* of the curving component 501.

In FIG. 17A, it can be seen that deformation of the portions of the metal stock sheet 601 that will form the vertical walls 501*a*, 501*b* from before to after forming the vertical walls 501*a*, 501*b* of the curving component 501 is mainly shear deformation. Forming the vertical walls 501*a*, 501*b* of the curving component 501 accompanied by deformation that is mainly shear deformation suppresses a reduction in the sheet thickness of the vertical walls 501*a*, 501*b* compared to the sheet thickness of the metal stock sheet 601. This thereby enables the occurrence of creasing and cracking in the vertical walls 501*a*, 501*b* to be suppressed.

During formation of the vertical walls 501*a*, 501*b*, the portions of the metal stock sheet 601 that will form the vertical walls 501*a*, 501*b* undergo compression deformation in the minimum principal strain direction of the shear deformation. Accordingly, as illustrated in FIG. 17B and FIG. 17C, shear creasing W occurs in the vertical walls 501*a*, 501*b* of the curving component 501 if the clearance between the die 602 and the punch 604 becomes large. In order to suppress such shear creasing W, it is effective to reduce the clearance between the die 602 and the punch 604 such that the clearance is brought close to the sheet thickness of the metal stock sheet 601 during formation of the vertical walls 501*a*, 501*b*.

As illustrated in FIG. 18A to FIG. 18D, it is necessary for an internal angle θ formed between the respective vertical walls 501*a*, 501*b* and the top plate 501*c* to be 90° or greater so as not to have a negative mold angle during forming. However, since the clearance during initial forming increases if too far over 90°, an angle close to 90° that is 90° or greater is advantageous. When a steel sheet with a sheet thickness of from 0.8 mm to 3.2 mm, and tensile strength of from 200 MPa to 1600 MPa, that is generally employed in structural members configuring automotive vehicle body framework, is used to form a component in which the height of the vertical walls 501*a*, 501*b* is 200 mm or less, the internal angle formed between the top plate 501*c* and the vertical walls 501*a*, 501*b* is preferably from 90° to 92°, and a clearance b between the die 502 and the punch 504 at the portions forming the vertical walls 501*a*, 501*b* at the point when forming of the vertical walls 501*a*, 501*b* is completed is preferably from 100% to 120% of the sheet thickness of the metal stock sheet 601.

Next, explanation follows regarding results of investigation into the occurrence of creasing in the curving component 501, using parameters of (1) the angle formed between the vertical walls 501*a*, 501*b* and the top plate 501*c*, (2) mold clearance (varying the sheet thickness t with respect to the fixed clearance b), (3) the pressure applied to the pad 503 (pad pressure), (4) the pressure applied to the blank holder 505 (holder pressure), and (5) the tensile strength of the material.

FIG. 19A is a perspective view illustrating the curving component 501. FIG. 19B is a plan view illustrating the curving component 501 in FIG. 19A, as viewed from above. FIG. 19C is a side view of the curving component 501 in FIG. 19A. FIG. 19D is a cross-section illustrating a cross-section of the curving component 501 taken along the line A-A in FIG. 19C. FIG. 20 is a cross-section of the mold.

the blank holder 505 (holder pressure) was varied. (5) Nos. 17 to 19 are examples of cases in which the tensile strength of the material was varied. The presence or absence of creasing occurrence was investigated in curving components manufactured for each Example.

It can be seen from the above table that unacceptable creasing of the components did not occur in the curving component 501 within the range of parameters investigated.

Explanation has been given above regarding examples in which curving hat-shaped cross-section components (the curving component 501) are formed using the hat-shaped cross-section component manufacturing apparatus 500 (see FIG. 5). However, the present invention is not limited thereto. For example, the hat-shaped cross-section component manufacturing apparatus 500 may be used to form hat-shaped cross-section components that have a uniform cross-section along the length direction, and do not curve in side view or in plan view.

Explanation has been given regarding exemplary embodiments of the present invention; however, the present invention is not limited to the above, and obviously various modifications other than the above may be implemented.

The entire content of Japanese Patent Application No. 2013-221522, filed on Oct. 24, 2013, is incorporated by reference in the present specification.

TABLE 1

| | CASE | Tensile Strength of Material (MPa) | Sheet Thickness t (mm) | θ (°) | Clearance b (mm) | b/t | Pad Pressure (MPa) | Blank Holder Pressure (MPa) | Creasing |
|---|---|---|---|---|---|---|---|---|---|
| Example | 1 | 980 | 1.8 | 90 | 1.8 | 1.00 | 5.83 | 2.50 | Absent |
| | 2 | 980 | 1.8 | 91 | 1.8 | 1.00 | 5.83 | 2.50 | Absent |
| | 3 | 980 | 1.8 | 92 | 1.8 | 1.00 | 5.83 | 2.50 | Absent |
| | 4 | 980 | 1.8 | 95 | 1.8 | 1.00 | 5.83 | 2.50 | Somewhat present |
| | 5 | 980 | 1.8 | 80 | 1.8 | 1.00 | 5.83 | 2.50 | Somewhat present |
| | 6 | 980 | 1.6 | 90 | 1.8 | 1.13 | 5.83 | 2.50 | Absent |
| | 7 | 980 | 1.4 | 90 | 1.8 | 1.29 | 5.83 | 2.50 | Somewhat present |
| | 8 | 980 | 1.2 | 90 | 1.8 | 1.50 | 5.83 | 2.50 | Somewhat present |
| | 9 | 980 | 1.0 | 90 | 1.8 | 1.80 | 5.83 | 2.50 | Somewhat present |
| | 10 | 440 | 1.6 | 90 | 1.8 | 1.13 | 2.33 | 1.50 | Absent |
| | 11 | 440 | 1.6 | 90 | 1.8 | 1.13 | 1.17 | 1.50 | Absent |
| | 12 | 440 | 1.6 | 90 | 1.8 | 1.13 | 0.58 | 1.50 | Absent |
| | 13 | 400 | 1.6 | 90 | 1.8 | 1.13 | 0.09 | 1.50 | Somewhat present |
| | 14 | 440 | 1.6 | 90 | 1.8 | 1.13 | 3.50 | 1.00 | Absent |
| | 15 | 440 | 1.6 | 90 | 1.8 | 1.13 | 3.50 | 0.75 | Absent |
| | 16 | 440 | 1.6 | 90 | 1.8 | 1.13 | 3.50 | 0.09 | Somewhat present |
| | 17 | 1310 | 1.8 | 90 | 1.8 | 1.00 | 5.83 | 2.50 | Absent |
| | 18 | 590 | 1.6 | 90 | 1.8 | 1.13 | 3.50 | 1.50 | Absent |
| | 19 | 440 | 1.6 | 90 | 1.8 | 1.13 | 2.33 | 1.50 | Absent |

The angle θ in Table 1 is the internal angle θ formed between the vertical walls 501*a*, 501*b* and the top plate 501*c*, as illustrated in FIG. 19D. The clearance b in Table 1 is the gap between the pad 503 and the punch 504, between the die 502 and punch 504, and the die 502 and blank holder 505, as illustrated in FIG. 20.

Each of the Examples 1 to 19 in Table 1 are examples of the present exemplary embodiment. In Table 1, "somewhat present" refers to the occurrence of creasing at an acceptable level. (1) Nos. 1 to 5 examples of cases in which the angle formed between the vertical walls 501*a*, 501*b* and the top plate 501*c* was varied. (2) Nos. 6 to 9 are examples of cases in which the mold clearance, more specifically the sheet thickness t with respect to a fixed clearance b, was varied. (3) Nos. 10 to 13 are examples of cases in which the pressure applied to the pad 503 (pad pressure) was varied. (4) Nos. 14 to 16 are examples of cases in which the pressure applied to

The invention claimed is:

1. A hat-shaped cross-section component manufacturing apparatus comprising:

a die that includes a forming face that presses both side portions of a metal sheet, and that includes an opening;

a punch that is disposed facing the opening of the die, wherein the punch is disposed inside the opening when a mold is closed, and wherein the punch includes a forming face that presses a central portion of the metal sheet;

a pad that is disposed inside the opening formed in the die, wherein the pad includes a forming face that presses and grips the central portion of the metal sheet against the punch when the mold is closed so as to configure a forming face corresponding to the forming face of the punch;

a holder that is disposed outside the opening and facing the die and movable toward the die, wherein the holder includes a forming face that presses and grips both side portions of the metal sheet against the die when the mold is closed so as to configure a forming face corresponding to the forming face of the die; and a pressure limiting device that includes:

floating blocks that are movable in a demolding direction with regard to the punch, the floating blocks being interposed between the pad and the holder and being configured to contact the pad in a state in which the holder and the die have moved to a forming bottom dead center, and a pair of holding arms that are provided at the holder, the pair of holding arms engaging with the floating blocks when the holder moves to the forming bottom dead center, and engagement of the holding arms with the floating blocks being released when the pad separates from the floating blocks during demolding, wherein the floating blocks are caused to move together with the holder during demolding after forming of a hat-shaped cross-section component having a hat-shaped cross-section, and pressing on the hat-shaped cross-section component by the pad and the holder is limited by the floating blocks, which are interposed between the pad and the holder.

2. The hat-shaped cross-section component manufacturing apparatus of claim 1, wherein the pressure limiting device includes a retention release section that enables movement of the floating blocks relative to the holder once the holder has moved a specific distance.

3. The hat-shaped cross-section component manufacturing apparatus of claim 2, wherein the retention release section releases the engagement between the holding arms and the floating blocks by contacting the holding arms.

4. The hat-shaped cross-section component manufacturing apparatus of claim 2, wherein the retention release section is integrally provided at the floating blocks.

5. The hat-shaped cross-section component manufacturing apparatus of claim 2, wherein the retention release section is provided at a base member to which the punch is fixed.

6. The hat-shaped cross-section component manufacturing apparatus of claim 1, wherein:

the holding arms are supported on the holder so as to be capable of swinging;

the holding arms engage with the floating blocks by the holding arms swinging toward one side; and the engagement between the holding arms and the floating blocks is released by the holding arms swinging toward another side.

7. A hat-shaped cross-section component manufacturing method employing the hat-shaped cross-section component manufacturing apparatus of claim 1, the hat-shaped cross-section component manufacturing method comprising:

a forming process of forming the hat-shaped cross-section component by configuring a metal sheet that is curved up-down by gripping a central portion of the metal sheet between the punch and the pad, and gripping both side portions of the metal sheet between the die and the holder, and moving the holder and die, and the punch and pad, up-down relative to each other; and a demolding process of demolding the hat-shaped cross-section component by moving one or both of the die or the holder in a demolding direction, in a state in which the pad and the floating blocks are in contact with each other.

* * * * *